US010527379B2

(12) United States Patent
Lee

(10) Patent No.: US 10,527,379 B2
(45) **Date of Patent: *Jan. 7, 2020**

(54) FIREARM ADAPTER

(71) Applicant: DBDROP, Inc., Fort Myers, FL (US)

(72) Inventor: Darryl S. Lee, Fort Myers, FL (US)

(73) Assignee: DBDROP INC., Fort Myers, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/290,193

(22) Filed: Mar. 1, 2019

(65) Prior Publication Data

US 2019/0195589 A1 Jun. 27, 2019

Related U.S. Application Data

(63) Continuation-in-part of application No. 15/912,965, filed on Mar. 6, 2018, now Pat. No. 10,352,642, which is a continuation of application No. 15/901,219, filed on Feb. 21, 2018, now Pat. No. 10,082,354, application No. 16/290,193, filed on Mar. 1, 2019, which is a continuation-in-part of application No. 16/184,582, filed on Nov. 8, 2018, now Pat. No. 10,274,279, which is a continuation of application No. 15/625,542, filed on Jun. 16, 2017, now Pat. No. 10,302,384, which is a continuation of application No. 15/499,430, filed on Apr. 27, 2017, now Pat. No. 10,066,890, said application No. 16/184,582 is a continuation of application No. 15/601,528, filed on May 22, 2017, now Pat. No. 9,891,017, and a continuation of application No. 15/642,467, filed on Jul. 6, 2017, now Pat. No. 10,190,839, which is a continuation of application No. 15/499,430, filed on Apr. 27, 2017, now Pat. No. 10,066,890, said application No. 16/184,582 is a (Continued)

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/32; F41A 21/325
USPC ..... 89/14.2, 14.3, 14.4; 42/1.06, 85, 86
See application file for complete search history.

(56) References Cited

U.S. PATENT DOCUMENTS 2,351,037 A 6/1944 Green
2,866,288 A 12/1958 Herter
(Continued)

FOREIGN PATENT DOCUMENTS

WO 2009139803 A2 11/2009

*Primary Examiner* — Bret Hayes
(74) *Attorney, Agent, or Firm* — Nicholas Pfeifer; Smith & Hopen, P. A.

(57) ABSTRACT

A flexible fit, easy to attach and align, firearm adapter that allows secure fitment of a muzzle device, such as a suppressor, to a broad range of firearm sizes and shapes, with a single device. These firearms would include difficult to fit barrel profiles that in many cases would go unsuppressed without this improvement over the prior art. An embodiment includes an anchor securable to a smooth section of a firearm barrel and a housing adapted to engage the anchor. The anchor and housing are sized to reach over or around barrel obstructions. An embodiment includes an alignment guide to bring the barrel into axial alignment with the muzzle device.

20 Claims, 13 Drawing Sheets

Related U.S. Application Data continuation of application No. 15/790,319, filed on Oct. 23, 2017, which is a continuation of application No. 15/601,528, filed on May 22, 2017, now Pat. No. 9,891,017, said application No. 16/184,582 is a continuation of application No. 15/674,622, filed on Aug. 11, 2017, now Pat. No. 10,161,704, and a continuation of application No. 16/031,483, filed on Jul. 10, 2018, which is a continuation of application No. 15/819,893, filed on Nov. 21, 2017, now Pat. No. 10,048,033, said application No. 16/184,582 is a continuation of application No. 15/912,965, filed on Mar. 6, 2018, now Pat. No. 10,352,642, which is a continuation of application No. 15/901,219, filed on Feb. 21, 2018, now Pat. No. 10,082,354, application No. 16/290,193, filed on Mar. 1, 2019, which is a continuation-in-part of application No. 16/253,998, filed on Jan. 22, 2019, which is a continuation-in-part of application No. 15/642,467, filed on Jul. 6, 2017, now Pat. No. 10,190,839, which is a continuation of application No. 15/499,430, filed on Apr. 27, 2017, now Pat. No. 10,066,890, said application No. 16/253,998 is a continuation-in-part of application No. 15/625,542, filed on Jun. 16, 2017, now Pat. No. 10,302,384, which is a continuation of application No. 15/499,430, filed on Apr. 27, 2017, now Pat. No. 10,066,890, and a continuation of application No. 15/601,528, filed on May 22, 2017, now Pat. No. 9,891,017.

(60) Provisional application No. 62/583,227, filed on Nov. 8, 2017.

(56) References Cited

U.S. PATENT DOCUMENTS

| | | | | |
|---|---|---|---|---|
| 3,045,379 | A | 7/1962 | Cutts | |
| 3,710,679 | A | 1/1973 | Werbell, III | |
| 3,797,155 | A | 3/1974 | Smith et al. | |
| 6,973,863 | B1 | 12/2005 | Jones | |
| 7,194,836 | B1 | 3/2007 | Urban | |
| 8,973,481 | B2 | 3/2015 | Dueck et al. | |
| 9,891,017 | B1 * | 2/2018 | Lee | F41A 21/325 |
| 10,048,033 | B1 * | 8/2018 | Lee | F41A 21/34 |
| 10,066,890 | B1 * | 9/2018 | Lee | F41A 21/325 |
| 10,082,354 | B1 * | 9/2018 | Lee | F41A 21/481 |
| 10,302,384 | B1 * | 5/2019 | Lee | F41A 21/325 |
| 2015/0184968 | A1 | 7/2015 | Fischer et al. | |
| 2015/0362276 | A1 | 12/2015 | Fischer | |

* cited by examiner

FIG. 1
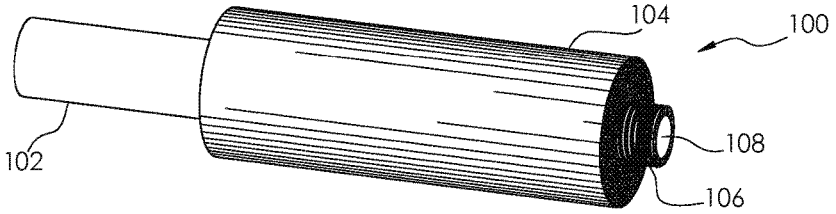
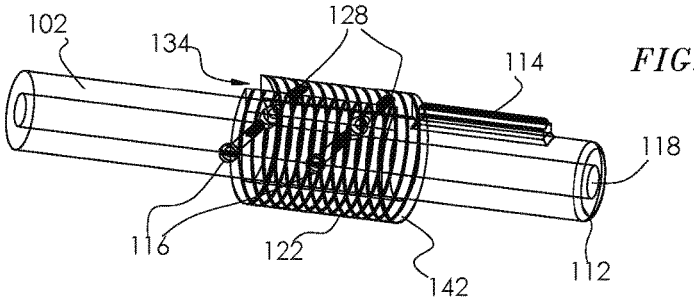
FIG. 2
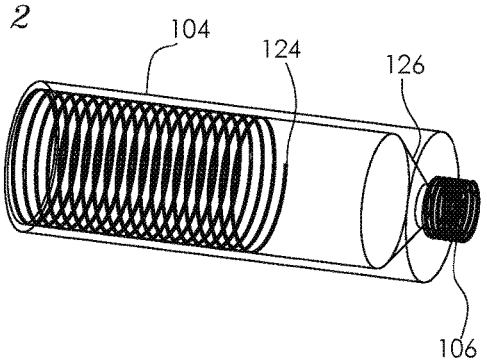
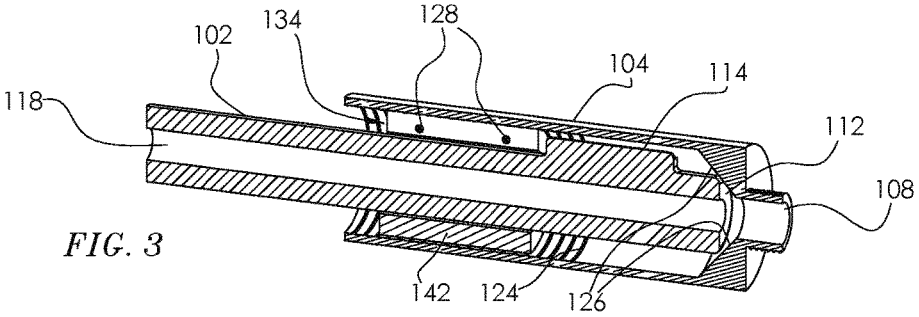
FIG. 3

FIG. 4
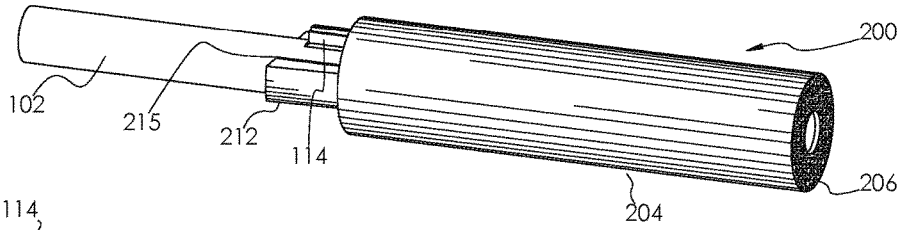
FIG 5
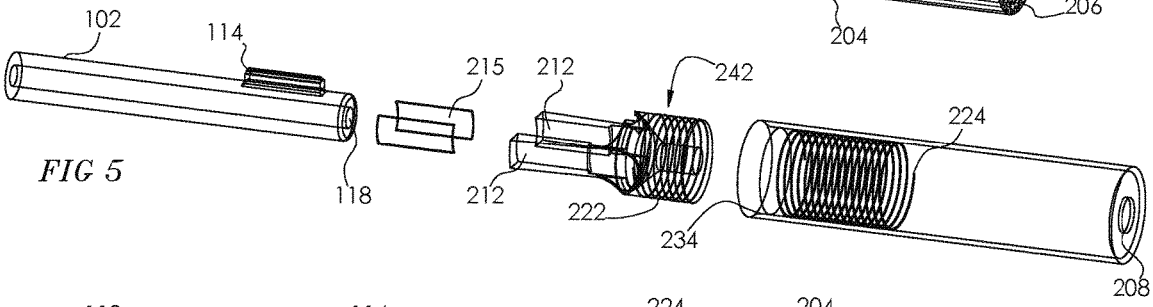
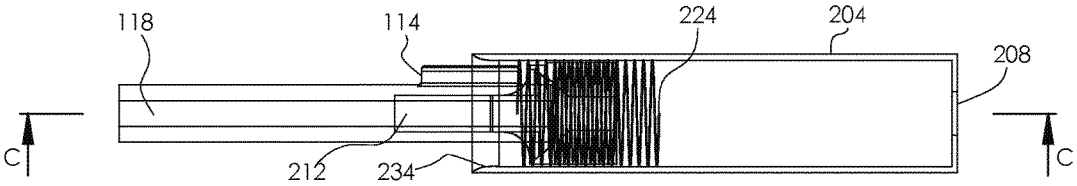
FIG. 6
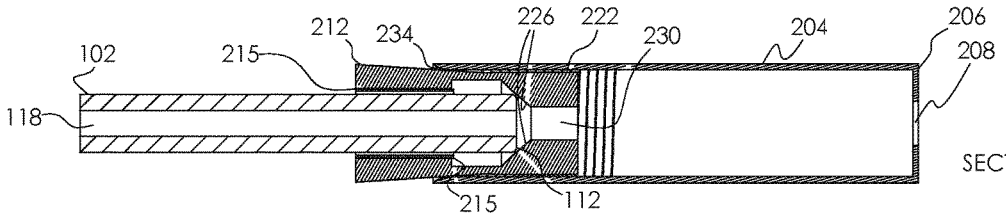
FIG. 7
SECTION C-C

FIG. 11
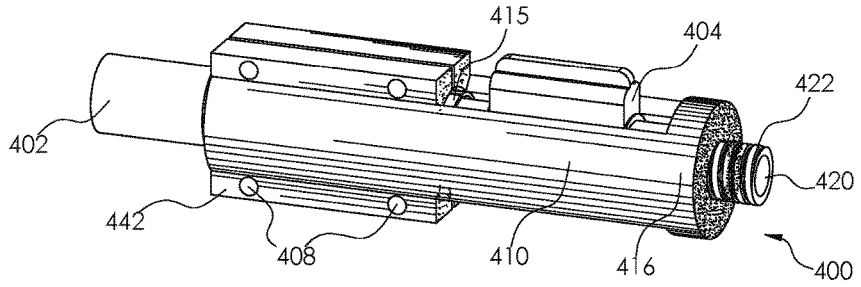
FIG. 12
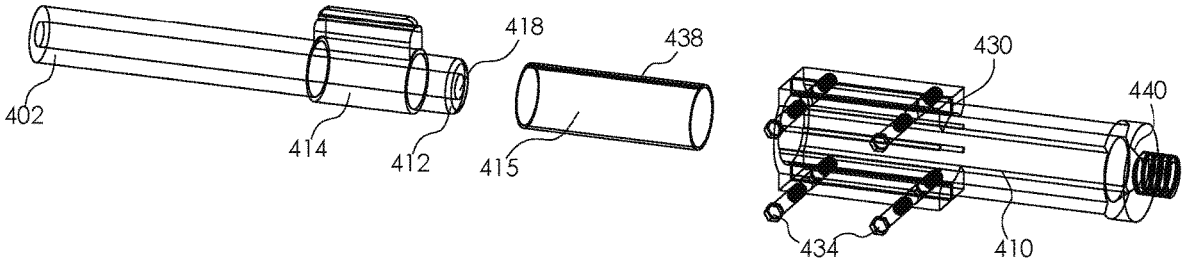
FIG. 13
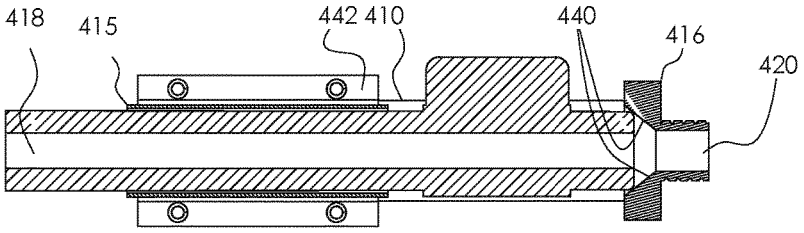
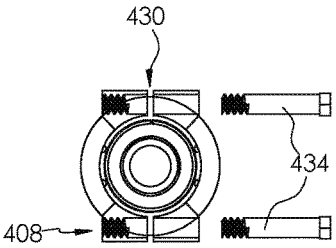
FIG. 14

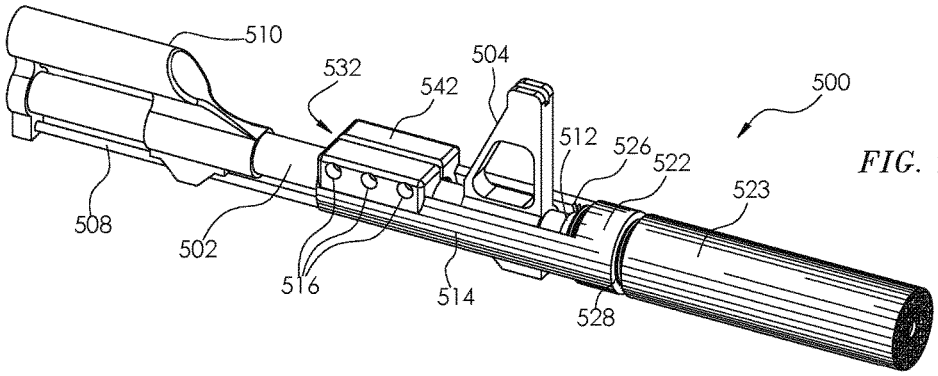
FIG. 15
FIG. 16
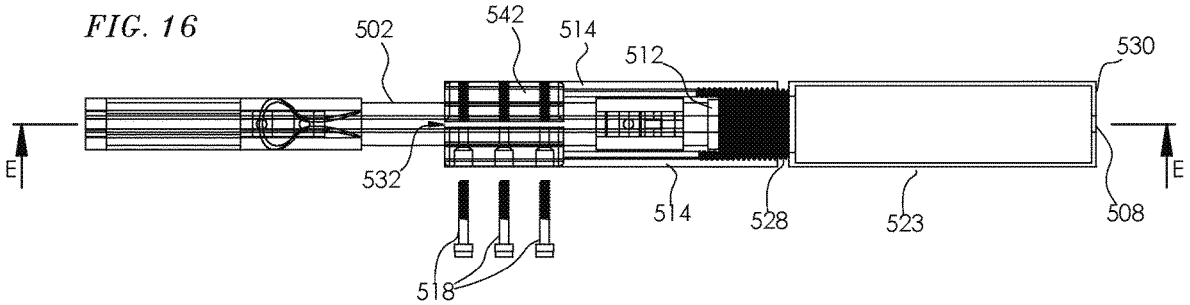

FIG. 19
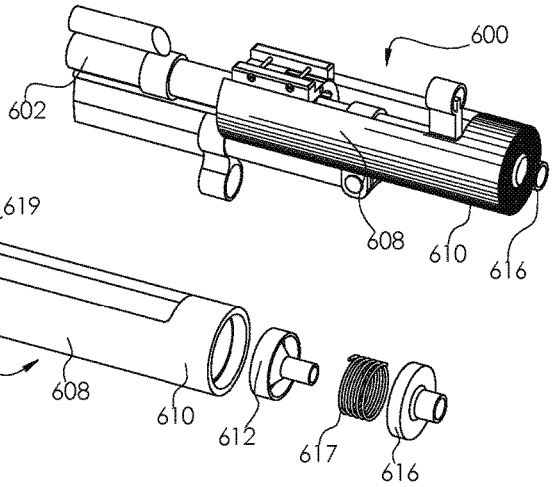
FIG. 20
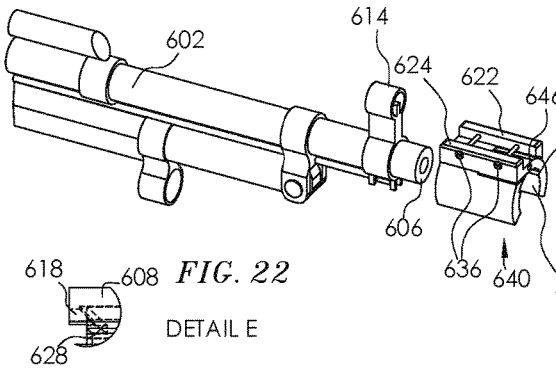
FIG. 22
FIG. 21
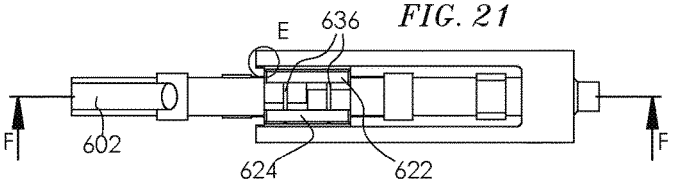
FIG. 23
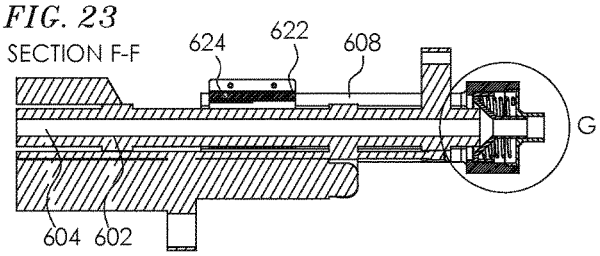
FIG. 24
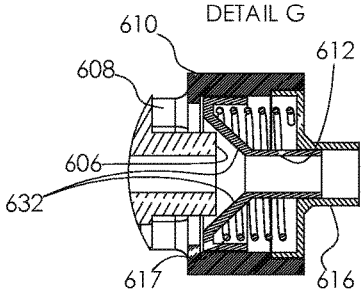

730
704
779
728
708
705
717
742
773
728
718

702
715

734
716
775
773
787
787
775

773
742

704
707
717
726
787
718
780
779
773

FIREARM ADAPTER

CROSS-REFERENCE TO RELATED APPLICATIONS

This nonprovisional application is a continuation-in-part of and claims priority to nonprovisional application Ser. No. 15/912,965, entitled "FIREARM SUPPRESSOR ADAPTER FOR BARRELS HAVING OBSTRUCTIONS," filed Mar. 6, 2018 by the same inventor, which is a continuation of and claims priority to nonprovisional application Ser. No. 15/901,219, entitled "FIREARM SUPPRESSOR ADAPTER FOR BARRELS HAVING OBSTRUCTIONS," filed Feb. 21, 2018 by the same inventor, now U.S. Pat. No. 10,082,354 issued on Sep. 25, 2018.

This nonprovisional application is a continuation-in-part of and claims priority to nonprovisional application Ser. No. 16/184,582, entitled "FIREARM SUPPRESSOR ADAPTER FOR FIREARM RAILS," filed Nov. 8, 2018 by the same inventor, which (1) claims priority to provisional application No. 62/583,227, entitled "Firearm Accessories," filed Nov. 8, 2017 by the same inventor; (2) is a continuation of and claims priority to nonprovisional application Ser. No. 15/625,542, entitled "Firearm Barrel Fitment Sleeve And Method Of Use," filed Jun. 16, 2017 by the same inventor, which is a continuation of and claims priority to U.S. Non-Provisional application Ser. No. 15/499,430 filed on Apr. 27, 2017, now U.S. Pat. No. 10,066,890 issued on Sep. 4, 2018 entitled "Firearm Suppressor Adapter," by the same inventor, and is also a continuation of and claims priority to U.S. Non-Provisional application Ser. No. 15/601,528, filed on May 22, 2017 now U.S. Pat. No. 9,891,017 issued on Feb. 13, 2018 entitled "Firearm Suppressor Adapter," by the same inventor; (3) is a continuation of and claims priority to nonprovisional application Ser. No. 15/642,467, entitled "Firearm Barrel Alignment Guide," filed Jul. 6, 2017 by the same inventor, now U.S. Pat. No. 10,190,839 issued on Jan. 29, 2019, which is a continuation of and claims priority to U.S. Non-Provisional application Ser. No. 15/499,430 filed on Apr. 27, 2017, now U.S. Pat. No. 10,066,890 issued on Sep. 4, 2018 entitled "Firearm Suppressor Adapter," by the same inventor; (4) is a continuation of and claims priority to nonprovisional application Ser. No. 15/790,319, entitled "Firearm Suppressor Adapter," filed Oct. 23, 2017 by the same inventor, which is a continuation of and claims priority to U.S. Non-Provisional application Ser. No. 15/601,528, filed on May 22, 2017 now U.S. Pat. No. 9,891,017 issued on Feb. 13, 2018 entitled "Firearm Suppressor Adapter," by the same inventor; (5) is a continuation of and claims priority to nonprovisional application Ser. No. 15/674,622, entitled "Firearm Adapter Configured to Mount to a Firearm Frame," filed Aug. 11, 2017 by the same inventor, now U.S. Pat. No. 10,161,704, issued on Dec. 25, 2018; (6) is a continuation of and claims priority to nonprovisional application Ser. No. 16/031,483, entitled "Device for Dampening Residual Effects from a Firearm Suppressor," filed Jul. 10, 2018 by the same inventor, which is a continuation of and claims priority to U.S. Non-Provisional application Ser. No. 15/819,893 filed on Nov. 21, 2017, now U.S. Pat. No. 10,048,033 issued on Aug. 14, 2018, entitled "Device for Dampening Residual Effects from a Firearm Suppressor," by the same inventor; and (7) is a continuation of and claims priority to nonprovisional application Ser. No. 15/912,965, entitled "Firearm Suppressor Adapter for Barrels Having Obstructions," filed Mar. 6, 2018 by the same inventor, which is a continuation U.S. Non-Provisional application Ser. No. 15/901,219 filed on Feb. 21, 2018 now U.S. Pat. No. 10,082,354 issued on Sep. 25, 2018, entitled "Firearm Suppressor Adapter for Barrels Having Obstructions," by the same inventor.

This nonprovisional application is a continuation-in-part of and claims priority to nonprovisional application Ser. No. 16/253,998, entitled "FIREARM ADAPTER," filed Jan. 22, 2019 by the same inventor, which (1) is a continuation in part of and claims priority to nonprovisional application Ser. No. 15/642,467, entitled "FIREARM BARREL ALIGNMENT GUIDE," filed Jul. 6, 2017 by the same inventor, which is a continuation of and claims priority to nonprovisional application Ser. No. 15/499,430, now U.S. Pat. No. 10,066,890, issued on Sep. 4, 2018, entitled "FIREARM SUPPRESSOR ADAPTER," filed Apr. 27, 2017 by the same inventor; and (2) is a continuation in part of and claims priority to nonprovisional application Ser. No. 15/625,542, entitled "FIREARM BARREL FITMENT SLEEVE AND METHOD OF USE," filed Jun. 16, 2017 by the same inventor which is a continuation of and claims priority to nonprovisional application Ser. No. 15/499,430, now U.S. Pat. No. 10,066,890, issued on Sep. 4, 2018, entitled "FIREARM SUPPRESSOR ADAPTER," filed Apr. 27, 2017 by the same inventor, and is also a continuation of and claims priority to nonprovisional application Ser. No. 15/601,528, now U.S. Pat. No. 9,891,017, issued on Feb. 13, 2018, entitled "FIREARM SUPPRESSOR ADAPTER," filed May 22, 2017 by the same inventor.

BACKGROUND OF THE INVENTION

1. Field of the Invention

This invention relates, generally, to firearms adapters. More specifically, it relates to a universal adapter for muzzle devices, such as firearm suppressors.

2. Brief Description of the Prior Art

Most gunfire produce sound that exceeds 140 dB, which can cause immediate and irreparable hearing loss to the gun operator and also significantly contributes to sound pollution. The effects of gun-fire noise are evidenced by the prevalence of hearing damage among veterans, law enforcement, and older individuals that have been around unsuppressed gunfire. Fortunately, suppressors generally reduce the sound of gunfire by 20 to 25 dB on average, reducing the sound to safe levels for the shooter.

For this reason, suppressors are gaining popularity. In some instances, having recognized the damaging effects of unsuppressed gunfire, the military and various law enforcement agencies are making suppressors available to those personnel that are exposed to gunfire. The anticipated resulting reduction in hearing damage from increased suppressor use is not only beneficial to the individual shooter and those around them, but it also provides a societal beneficial by reducing healthcare cost associated with hearing loss.

Up to now, most firearms were manufactured without the thought of or ability to accept a suppressor. Many barrels were made with obstructions, protrusions and profiles that are not conducive to attaching a suppressor to the barrel. In addition, most barrels were made without the necessary cut and thread profile needed to install modern suppressors. Attaching a suppressor to a firearm with a profile that was other than round involved primitive set screw attachment, non-aligned compression or attaching the adapter to the obstruction itself via a single, non-centerline attachment point.

All the current methods have drawbacks and problems that prevent the respective adapters from being widely adopted. In addition, most adapters do not account for obstructions on the firearm barrel. There are millions of firearms that have some sort of obstruction or abnormal profile at the distal end of the barrel. Some are minor as in the case of an iron sight. Some are much more complex like a large bore revolver or the popular surplus guns like the AK-47 and SKS. It is currently close to impossible to fit a suppressor to a large bore revolver with a common profile without the original manufacturer putting threads on the end of the barrel during manufacture.

Accordingly, what is needed is a firearm adapter that can overcome all of the problems listed above, providing an easy-to-use, adapter that can quickly, accurately, securely, and concentrically attach a muzzle device, such as a suppressor or suppressor extension to the barrel of a firearm. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an easy-to-use, adapter that can quickly, accurately, securely, and concentrically attach a muzzle device, such as suppressor or suppressor extension to the barrel of a variety of firearms is now met by a new, useful, and nonobvious invention.

In an embodiment, the novel structure includes an anchor that can be secured to a firearm barrel and an outer sheath that can reach around barrel obstructions and connect to the anchor. The anchor includes a length extending between a proximal end and a distal end with a longitudinal axis extending parallel to the length. The anchor further includes an outer lateral surface and an inner lateral surface, wherein the outer lateral surface includes threads. A gap extends at least partially along the length of the anchor and passes through both the inner and outer lateral surfaces, such that a portion of the anchor has a semicircular cross-section with respect to the longitudinal axis. At least a section of the inner lateral surface has a radius greater than a radius of the barrel of the firearm when the anchor is attached to the barrel of the firearm and is adapted to attach to a barrel of a firearm in a manner that prevents rotation of the anchor with respect to the barrel of the firearm.

At least a section of the outer lateral surface of the anchor has a radius greater than the sum of the radius of the barrel of the firearm and a lateral extending distance of any barrel obstruction residing at least partially between a proximal end of the anchor and a distal end of the firearm barrel when the anchor is attached to the barrel of the firearm. In other words, the anchor extends laterally beyond any barrel obstructions.

The outer sheath also has a length extending parallel to a longitudinal axis and an outer lateral surface and an inner lateral surface. The inner lateral surface has a circular cross-section with respect to the longitudinal axis of the outer sheath and threads configured to engage the threads on the outer lateral surface of the anchor. The distal end of the outer sheath includes a centrally located bore axially aligned with the longitudinal axis of the outer sheath, thereby providing passage for a fired projectile.

An embodiment includes an alignment guide secured within the outer housing. The alignment guide is a generally frustoconical-shaped, being tapered in a distal direction thereby causing the barrel of the firearm to axially align with the longitudinal axis of the outer housing as the barrel of the firearm is forced into the outer housing. Alternatively, an embodiment includes the alignment guide secured within the anchor. Again, the alignment guide has a generally frustoconical shape being tapered in a distal direction, thereby causing the barrel of the firearm to axially align with the longitudinal axis of the anchor as the barrel of the firearm is forced into contact with the anchor.

An embodiment includes a tubular cylindrical suppressor mount secured to the distal end of the outer housing in axial alignment with the longitudinal axis of the outer housing. The suppressor mount includes threads on an outer lateral surface adapted to threadedly engage a firearm suppressor. Alternatively, the suppressor can be directly integrated into the outer housing.

In an embodiment, the anchor is adapted to adjust the radius of the inner lateral surface by adjusting a width of the gap. Moreover, the anchor can attach to the barrel of the firearm via a threaded fastener extending through a fastener aperture on one side of the gap and extending into a threaded fastener receipt on a second side of the gap.

In an embodiment, a pair of proximally extending lever arms are secured to the anchor. The lever arms increase in lateral thickness in a proximal direction. The anchor gap resides between the lever arms. The outer housing has a tapered proximal end configured to apply an inward radial force on the lever arms as the outer housing threadedly engages the anchor and moves in a proximal direction with respect to the anchor. Each of the lever arms preferably has a curved inner surface intended to mate with the curvature of the firearm barrel when the anchor is attached to the firearm barrel.

An embodiment of the invention includes a temporary attachable anchor having a proximal end and a distal end with a length extending therebetween and a longitudinal axis extending parallel to the length. The anchor further includes an outer lateral surface and an inner lateral surface, wherein at least a portion of the inner lateral surface has a semicircular cross-section to mate with a curvature of the firearm barrel.

Two or more arm members are integrated with the anchor or attachable to the anchor. The arm members are laterally separated creating a first receiving area between the arm members for receiving barrel obstructions on the firearm barrel.

The adapter further includes an alignment guide housing integrated with or attachable to distal ends of the arm members. The alignment guide housing has a central longitudinal axis and a threaded suppressor mount aligned with the central longitudinal axis. The threaded suppressor may have threads on the inner lateral surface or the outer lateral surface and are configured to engage a suppressor.

The alignment guide is secured within the alignment guide housing and has a generally frustoconical shape tapered in a distal direction. The tapered shape thereby causes the firearm barrel to axially align with the longitudinal axis of the alignment guide housing as a muzzle end of the firearm barrel is forced into the alignment guide housing. An embodiment may include the alignment guide disposed within the alignment guide housing and a biasing member in mechanical communication with the alignment guide and a distal stop. The biasing member imposes a biasing force on the alignment guide in a proximal direction.

An embodiment includes a gap extending at least partially along the length of the anchor that passes through both the inner and outer lateral surfaces, such that a portion of the anchor has a semicircular cross-section with respect to the longitudinal axis. The inner lateral surface of the anchor thus has an adjustable diameter by adjusting a width of the gap. The anchor attaches to the firearm barrel via a threaded fastener extending through a fastener aperture on one side of the gap and extending into a threaded fastener receipt on a second side of the gap.

An embodiment of the firearm adapter include an anchor attachable to the firearm barrel by contracting around a smooth section of the firearm barrel and a housing being integrated with or attachable to a muzzle device and adapted to attach to or engage the anchor to prevent relative axial movement between the anchor and the housing with respect to the longitudinal axis.

An embodiment includes a protrusion proximate a proximal end of the housing. The protrusion extends in a radial direction towards the anchor and is adapted to engage the anchor, thereby prevent movement of the housing with respect to the firearm in a longitudinal direction. In an embodiment, a projection extends in a radial direction from the anchor towards the housing and a projection passage is disposed on the housing. The projection passage is adapted to receive the projection and prevent movement of the housing with respect to the anchor in a longitudinal direction.

An embodiment includes threads disposed on the anchor and threads disposed on the housing proximate the proximal end of the housing, wherein the threads on the housing are adapted to threadedly engage the threads on the anchor. An embodiment includes a fastener aperture proximate the proximal end of the housing and a fastener receipt disposed in the anchor, such that a fastener can pass through the fastener aperture and engage the fastener receipt to secure the housing to the anchor.

An embodiment further includes a gap extending at least partially along the length of the anchor and passing through both the inner and outer surfaces, such that at least a section of the anchor has an adjustable cross-sectional area.

An embodiment includes an alignment guide residing at least partially within the housing or muzzle device. The alignment guide has a central bore hole sized to permit passage of a projectile, but prevent passage of a firearm muzzle or a pre-existing muzzle device secured to the firearm. In an embodiment, the alignment guide has a frustoconical shape and tapers towards the central longitudinal axis. The frustoconical shape thereby funnels the muzzle or pre-existing muzzle device into axial alignment with the central longitudinal axis.

An embodiment includes a gas containment sleeve secured to or integrated with the alignment guide. The gas containment sleeve is sized to reside within a pre-existing muzzle device or ensleeve the pre-existing muzzle device. The gas containment sleeve is gas impermeable to prevent discharged gasses from laterally escaping through the pre-existing muzzle device.

An object of the invention is to provide a firearm adapter configured to fit most firearms on the market including those with barrel obstructions and those that were previously incapable of having a muzzle device attached thereto.

An object of the invention is to provide an easy-to-use, adapter that can quickly, accurately, securely, and concentrically attach a muzzle device, such as a suppressor, suppressor extension, or rail attachment to the barrel of a firearm.

It is another object of the invention to provide a firearm adapter that is far less costly to manufacture due to a one size fits all system, and to eliminate the need to manufacture hundreds of sizes and configurations.

In addition, it is an object of this invention to provide an adapter, which can be secured to or integrated with a muzzle device, such as a suppressor and/or a suppressor extension; and provide an adapter that can attach to one or multiple firearm accessories, including, but not limited to a bipod, an iron sight, a sling mount, a rail for mounting accessories, a hand guard for installation from barrel heat, a forward grip, a flashlight, and a laser.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which:

FIG. 1 is a perspective view of an embodiment of the present invention secured to a firearm barrel.

FIG. 2 is a disassembled wireframe view of an embodiment of the present invention highlighting the internal mechanisms of the adapter.

FIG. 3 is a sectional view of FIG. 1.

FIG. 4 is a perspective view of an embodiment of the present invention secured to a firearm barrel.

FIG. 5 is a disassembled wireframe view of an embodiment of the present invention highlighting the internal mechanisms of the adapter.

FIG. 6 is a wireframe elevation view of the embodiment in FIGS. 4-5.

FIG. 7 is a sectional view of FIG. 6.

FIG. 11 is a perspective view of an embodiment of the present invention secured to a firearm barrel.

FIG. 12 is a disassembled wireframe view of an embodiment of the present invention highlighting the internal mechanisms of the adapter.

FIG. 13 is a sectional view of FIG. 11.

FIG. 14 is an end view of the embodiment depicted in FIG. 11.

FIG. 15 is a perspective view of an embodiment of the present invention secured to a firearm barrel.

FIG. 16 is a wireframe view of an embodiment of the present invention highlighting the internal mechanisms of the adapter.

FIG. 19 is a perspective view of an embodiment of the present invention secured to a firearm barrel.

FIG. 20 is a disassembled view of an embodiment of the present invention highlighting the internal mechanisms of the adapter.

FIG. 21 is top view of FIG. 15.

FIG. 22 is a close-up view of detail E in FIG. 21.

FIG. 23 is a sectional view of FIG. 21.

FIG. 24 is a close-up view of detail G in FIG. 23.

DETAILED DESCRIPTION OF THE INVENTION

Figure 8:
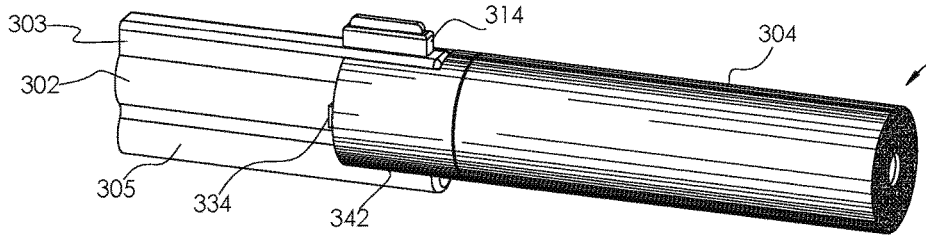
FIG. 8 is a perspective view of an embodiment of the present invention secured to a firearm barrel.

In the following detailed description of the present invention, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention is a firearm adapter configured to fit most firearm barrels. The adapter preferably attaches to the smooth section of a barrel and doesn't require any tooling or permanent modification to the barrel for securement of the adapter to a firearm. The ability of the present invention to attach to a variety of gun barrels reduces the costs associated with manufacturing, packaging, labeling, and stocking because a single adapter of the present invention can replace thousands of different muzzle device/suppressor and muzzle device/suppressor adapter designs. The following description references suppressors and integrated suppressors as well as muzzle devices as a whole. The broader term "muzzle device," includes any firearm accessories generally designed to attach to or extend from a muzzle end of a firearm.

The present invention is an improvement over previous devices in which the adapter had to be anchored to the barrel irregularity or obstruction. These barrel parts can include an iron sight, a flash hider, a barrel band and other protrusions, were never meant to accept the pulling force of a suppressor, or other muzzle device, while in use. In the case of attachment to the iron sight, pulling from a single point on an otherwise circular profile can cause a dangerous out of alignment condition at the distal end of the muzzle device. A slight misalignment at the anchor point will be magnified over the distance between the anchor point and the muzzle end of the muzzle device. In contrast, the present invention reaches past the barrel obstruction or protrusion to attach to an unobstructed section of the barrel or firearm.

Referring now to FIGS. 1-3, an embodiment of firearm adapter 100 is designed to attach to barrel 102 having iron sight 114 near muzzle end 112. Adapter 100 includes anchor 142 having an adjustable gap/slot 134 to slide on and around a barrel obstruction and also give anchor 142 an adjustable inner diameter to fit barrels of various sizes. Each side of slot 134 includes apertures 128 for receiving fasteners 116 which provide the necessary clamping force to tighten anchor 142 to barrel 102. In an embodiment, aperture 128 on one side of slot 134 are threaded to engage a threaded male end of fasteners 116. It is contemplated that any number and any type of fastener known to a person of ordinary skill in the art may be employed to reduce the inner diameter of anchor 142 and secure said anchor to barrel 102. Preferably, the fasteners only engage the anchor to avoid permanently damaging the barrel of the firearm.

Anchor 142 also includes threads 122 on an outer lateral surface. Threads 122 are intended to engage threading 124 on an internal surface of outer housing 104. The thread height/depth is a factor of the intended adjustment of the inner diameter of anchor 142. With proper thread height/depth, anchor 142 can be adjusted to mate to a variety of barrel diameters and still threadedly engage outer housing 104.

Outer housing 104 further includes alignment guide 126 designed to funnel muzzle end 112, and in turn barrel bore 118 into concentric/axial alignment with bore 108 in outer housing 104. The funneling alignment organically occurs as outer housing 104 is rotationally tightened onto anchor 142. Anchor 142 is fixed along the longitudinal axis of the barrel and the threaded engagement cause outer housing 104 to move in a linear direction (along the longitudinal axis of barrel 102) as outer housing 104 is rotated with respect to anchor 142. As outer housing 104 moves proximally (towards the handle of the firearm, i.e. a direction away from the muzzle end) the muzzle end 112 comes into contact with alignment guide 126 and the tapered slope forces outer housing 104 to axially align with barrel 102.

Alignment guide 126 also creates a seal with muzzle 112. In an embodiment, alignment guide 126 may include a compressible material to further enhance the seal between the alignment guide 126 and muzzle 112. Ultimately, the seal prevents the hot gasses leaving barrel bore 118 from traveling back towards the firearm operator and forces all of the gasses into the muzzle device secured to the distal end of outer housing 104.

The distal end of outer housing 104 includes a threaded mount 106 configured to threadedly engage a muzzle device. Mount 106 is axially aligned with the longitudinal axis of outer housing 104 to ensure that bore 108 axially aligns with barrel bore 118 when adapter 100 is secured to firearm barrel 102. In an embodiment, mount 106 may attach to a muzzle device via any fastening methods known to a person having ordinary skill in the art. In addition, an embodiment may include the muzzle device directly integrated into outer housing 104.

As depicted in FIG. 3, the inner radius of outer housing 104 must be greater than the outer radius of firearm barrel 102 plus the height of iron sights 114. The length of outer housing 104 must also be at least as long as the distance from a smooth section of barrel 102, that is proximally located with respect to the obstruction, to muzzle end 112. Essentially, housing 104 reaches around and behind obstruction 114 to threadedly engage anchor 142. It should be noted that while the exemplary figures depict a barrel obstruction in the form of iron sights 114, the present invention is designed to account for any type of obstruction. The adapter, however, can also be used on barrels without obstructions.

In an embodiment, outer housing 104 may engage anchor 142 using a fastening method other than threads, so long as the outer housing 104 can engage anchor 142 at any point along their respective longitudinal axes. For example, outer housing 104 may use a cam locking fastener to clamp around anchor 142. In addition, anchor 142 and outer housing 104 may remain secured to barrel 102 even when the muzzle device is not in use.

Referring now to FIGS. 4-7, an embodiment of the adapter, generally denoted by reference numeral 200, includes anchor 242 configured to compress around barrel 102 as outer housing 204 translates proximally along the longitudinal axis of anchor 242 and engages lever arms 212. As depicted, outer housing 204 is actually a suppressor with the internal baffles (not shown). In an embodiment, the suppressor/muzzle device can mount to outer housing 204 rather than be directly integrated as depicted by the exemplary illustrations in FIGS. 4-7.

Outer housing 204 further includes a distal end with a centrally located aperture 208 through which a projectile travels when fired. Near the proximal end, outer housing 204 includes threads 224 designed to engage threading 222 on anchor 242. The proximal end of outer housing 204 further includes tapered compression surface 234 intended to contact and compress lever arms 212 as outer housing 204 moves in the proximal direction with respect to anchor 242.

As previously noted, adapter 200 includes anchor 242 designed to compressively engage barrel 102. This compression engagement is accomplished via two or more lever arms 212, each having a tapered design such that the width in the radial direction is increases in a direction moving from the distal end to the proximal end of each lever arm 212. Thus, outer housing 204 causes lever arms 212 to compress inwardly in a radial direction as outer housing 204 moves in a proximal direction and moves along the outer surfaces of lever arms 212.

As depicted in FIGS. 4-7, anchor 242 includes two lever arms 212, designed to flex in a radial direction, in a diametrically opposed relationship. It is considered, however, that more than two lever arms may be used, so long as the lever arms are generally equidistantly spaced about the circumference of anchor 242, thereby ensuring that anchor 242 maintains a concentric axial alignment with barrel 102 when anchor 242 is compressively secured to barrel 102. In addition, the number and size of lever arms 212 is dependent on the size and locations of barrel obstructions 114. The exemplary barrel obstruction as depicted is an iron sight, but any type of obstruction is considered.

FIGS. 4-7 also depict the use of fitment inserts 215 designed to reside between barrel 102 and lever arms 212. Fitment inserts 215 are made of a compressible material, such as rubber or another synthetic compressible material, to provide an improved compression fit between anchor 242 and barrel 102. Fitment inserts 215 are also heat resistant to avoid melting as a result of barrel heating while firing. The number and size of fitment inserts 215 are dependent on the number and size of lever arms 212. Fitment inserts 215 can also have certain thicknesses to help fit adapter 200 to barrels of various sizes. Furthermore, fitment inserts 215 may further provide a secure gripping surface using e.g., grooves, ridges, or slits, on an outer surface and/or inner surface of inserts 215, for a more secure attachment of the anchor to a smooth metallic gun barrel. An embodiment of fitment insert 215 may have a flexible tubular structure with a slot extending the entire length of the insert, such that the tubular structure has an incomplete circumference and can be adjusted to fit around barrels of various diameters.

Anchor 242 further includes alignment guide 226 to funnel barrel 102 into axial alignment with bore 230 and ultimately aperture 208 in outer housing 204. As anchor 242 moves proximally (towards the handle of the firearm) the muzzle end 112 comes into contact with alignment guide 226 and the tapered slope forces anchor 242 to axially align with barrel 102. Alignment guide 226 also creates a seal with muzzle 112. In an embodiment, alignment guide 226 may include a compressible material thereon to further enhance the seal between the alignment guide 226 and muzzle 112. Ultimately, the seal prevents the hot gasses leaving barrel bore 118 from traveling back towards the firearm operator and forces all the gasses into the muzzle device.

As depicted in FIGS. 6-7, the attachment of adapter 200 on barrel 102 includes anchor 242 axially forced onto the distal end of barrel 102 such that muzzle end 112 contacts alignment guide 226 to force axial alignment between anchor 242 and barrel 102. Fitment inserts 215 are placed between lever arms 212 and barrel 102; and anchor 242 is oriented such that lever arms 212 contact a portion of the distal end of barrel 102 lacking obstructions 114 to help ensure a secure compression of anchor 242 to barrel 102. Outer housing 204 is then rotated into threaded engagement with anchor 242. Compression surface 234 on outer housing 204 forces lever arms 212 inwardly in a radial direction to tighten the compression of lever arms 212 around barrel 102. At a certain point, adapter 200 will be securely attached to barrel 102 and will automatically have axially aligned with firearm bore 118.

In an embodiment, outer housing 204 may engage anchor 242 using a fastening method other than threads, so long as the outer housing 204 can engage anchor 242 at any point along their respective longitudinal axes. For example, outer housing 204 may use a cam locking fastener to clamp around anchor 242.

Figure 9:
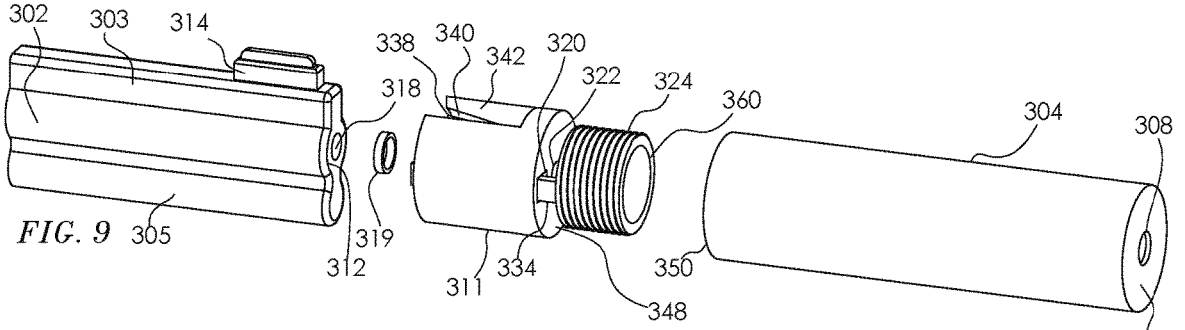
FIG. 9 is a disassembled wireframe view of an embodiment of the present invention highlighting the internal mechanisms of the adapter.
Figure 10:
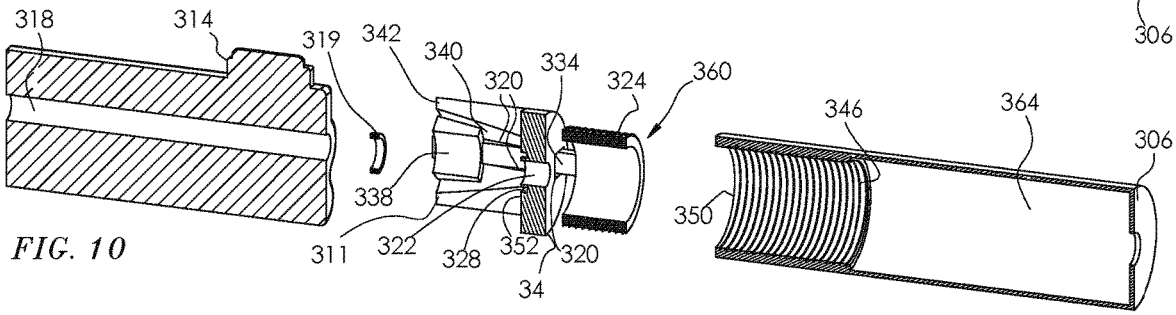
FIG. 10 is a sectional view of the embodiment in FIG. 9.
Figure 17:
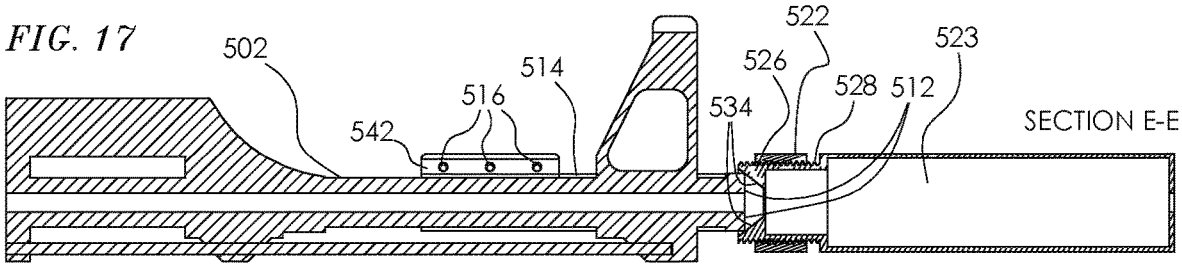
FIG. 17 is a sectional view of FIG. 15.

Referring now to FIGS. 8-10, an embodiment of the adapter, generally denoted by reference numeral 300, includes anchor 342 having two or more wedges 338 for compressively securing adapter 300 to barrel 302. Exemplary barrel 302 is a common profile of a large bore revolver. This profile includes the rounded barrel merged with square upper profile 303, round lower profile 305, and iron sight 314. Historically, suppressors/muzzle devices were unable to mount to the oddly shaped large bore revolver. Adapter 300, however, is designed to overcome the distinct obstructions—square upper profile 303, round lower profile 305, and iron sight 314—and ultimately attach a muzzle device to a large bore revolver. While, the exemplary barrel is a large bore revolver, adapter 300 may be used with various other barrel shapes.

Anchor 342 is comprised of translation mechanism 360 and stationary component 311. Stationary component 311 includes a tapered inner surface 340 that reduces the inner diameter of stationary component 311 moving in a distal direction. Stationary component 311 further includes wedge alignment channels 320 generally extending the length of stationary component 311 and passing through distal end cap 349. Distal end cap 349 has central axial bore 322 for passage of a projectile and an embodiment includes a grommet channel 328 on interior surface 352 for receiving sealing grommet 319, which is intended to create a seal between muzzle 319 and stationary component 311 to prevent high pressure gases from escaping.

Translation mechanism 360 is distally located from stationary component 311 and includes a pair of arm member 334 extending in a proximal direction. Each arm member 334 passes through and resides within wedge alignment channels 320. Each arm member 334 is attached to a wedge 338. Wedges 338 are diametrically opposed from each other and include a concave inner surface to aid in the axial alignment of anchor 342 with a smooth curved section of barrel 302.

The distal end of translation mechanism 39 includes a hollow cylindrical section with threads 324 on its outer surface. Threads 324 are designed to engage threads 346 on outer housing 304. Rotation of outer housing 306 thus causes translation of translation mechanism 360 about the longitudinal axis of outer housing 304. As translation mechanism 360 is pulled distally into outer housing 304, wedges 338 are also pulled distally along the tapered inner surface 340 causing wedges 338 to compress around barrel 302.

The attachment of adapter 300 to barrel 102 is achieved by forcing muzzle 312 into contact with internal surface 352 and/or sealing grommet 319. Outer housing 304 is then rotated onto threaded section of translation mechanism 360. Outer housing 360 is continually rotated until translation mechanism 360 has pulled wedges 338 sufficiently in a distal direction to create a compression attachment of anchor 342 to barrel 102. The compression fit automatically axially aligns aperture 308 with firearm bore 318.

In exemplary FIGS. 8-10, outer housing 304 is again integrated into a muzzle device, such as a suppressor that would typically have baffles in section 364, which are not depicted. Alternatively, outer housing 304 can be detachably coupled to a muzzle device via any fastening method known to a person of ordinary skill in the art, such as through a threaded mount similar to the one shown in FIGS. 1-3.

Referring now to FIGS. 11-14, an embodiment of the adapter, generally denoted by reference numeral 400, is designed to reach past and around barrel obstructions and has a single piece construction. It is possible, however, for the various components to be removably attached to each other. As depicted the rearward proximal end of adapter 400 includes anchor portion 442, which includes two halves that can be fastened together. The two-half construction creates gap 430 to allow anchor portion 442 to separate and pass around barrel obstructions, such as banded iron sight 414, when barrel 102 slides into adapter 400. While the proximal end is divided into two halves, it is considered that anchor portion 442 may be divided into any number of parts to create a plurality of gaps 430 through which obstructions may pass.

Anchor 442 further includes one or more fasteners apertures 408 for receiving fasteners 434. Fasteners 434 secure the two halves of anchor portion 442 together and act to clamp the two halves around barrel 102. One of the halves may include threads on the internal surface of fastener apertures 434 that are designed to engage threads on the end of fastener 434. Fasteners 434 are depicted as screws, but any type of fastener may be used to force the two halves of anchor portion 442 together to clamp anchor 442 around barrel 102.

The internal surfaces of each half are also curved to mate with the curved surface of the barrel. The curvature ensures proper concentric alignment when clamping around barrel 102. An embodiment may include fitment insert 415. Fitment insert 415 has a flexible tubular structure with slot 438 extending the entire length of the insert, such that the tubular structure has an incomplete circumference and can be adjusted to fit around barrels of various diameters and their respective obstructions 414. Fitment insert 415 is designed to reside between barrel 402 and anchor portion 442 to allow for greater compression forces on the barrel, account for barrels of varying sizes, and improve the gription of the anchor on the barrel. Fitment insert 415 is preferably made of a compressible material, such as rubber or another compressible material, to provide an improved compression fit between anchor 442 and barrel 402. Fitment insert 415 is also heat resistant to avoid melting as a result of the barrel heating during operation of the firearm. Fitment insert 415 can be specifically made at different thicknesses to help fit adapter 400 to barrels of various sizes. Furthermore, fitment insert 415 may include a secure gripping surface using e.g., grooves, ridges, or slits, on an outer surface and/or inner surface of insert 415, for a more secure attachment of the anchor to a smooth metallic gun barrel. An embodiment of fitment insert 415 may include a plurality of semicircular pieces rather than a tubular shape with a slot extending the length of the insert.

Anchor portion 442 is attached to alignment guide housing 416 via two arms members 410. Arm members 410 are generally semicircular, but can be any general shape, and have some degree of flexibility to allow gap 430 in anchor portion 442 to expand as need for various barrel obstructions. The number, size, and location of arm members 410 can vary depending on the profile of the firearm barrel on which adapter 400 is intended to be mounted.

Alignment guide housing 416 includes alignment guide 440 with a tapered inner surface for receiving muzzle end 412 of barrel 402. As adapter 400 moves proximally (towards the handle of the firearm) the muzzle end 412 comes into contact with alignment guide 440 and the tapered slope forces adapter 400 to axially align with barrel 402. Alignment guide 440 also creates a seal with muzzle 412. In an embodiment, alignment guide 440 may include a compressible material thereon to further enhance the seal between the alignment guide 440 and muzzle 412. Ultimately, the seal prevents the hot gasses leaving barrel bore 418 from traveling back towards the firearm operator and forces all of the gasses into the muzzle device.

The distal end of alignment guide housing 416 includes mount 422, which includes projectile bore 420 and threads on its outer surface. A muzzle device, not shown, can be mounted on threaded mount 422 using the threads, or mount 422 can employ another fastening method as known to a person of ordinary skill in the art. Moreover, adapter 400 can remain secured to barrel 402 when a muzzle device is not in use. Alternatively, an embodiment may include the muzzle device directly integrated into the distal end of adapter 400.

Figure 18:
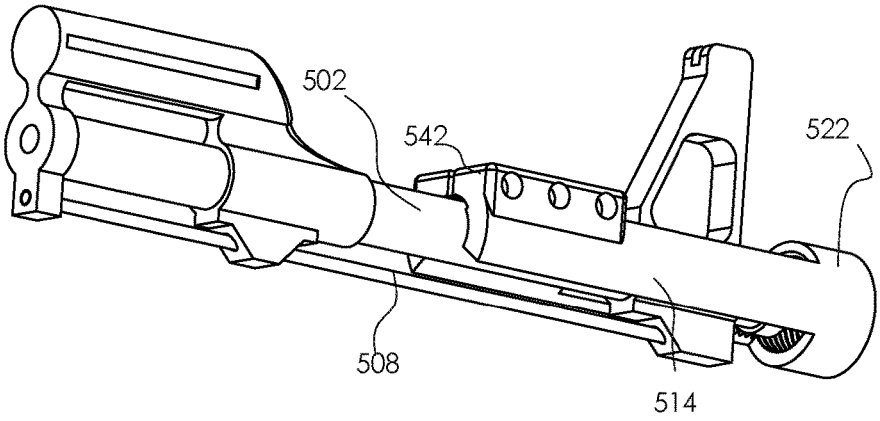
FIG. 18 is a bottom perspective view of FIG. 15.

Referring now to FIGS. 15-18, adapter embodiment 500, having a similar construction as embodiment 400, includes anchor portion 542 having fastener apertures 516 located on only an upper end of anchor portion 542. Fasteners 518 are intended to clamp anchor portion 542 to barrel 502 by threadedly engaging fastener apertures 516 having internal threads. Furthermore, as depicted in FIG. 18, the underside of anchor portion 542 is cut out to account for various barrel obstructions such as cleaning rod 508 typically found on an AK-47. This configuration also allows adapter 500 to drop onto the barrel rather than having to slide onto the barrel, which makes the avoidance of barrel obstructions easier to achieve. It should be noted that an inner surface (the surface that mates with the barrel) of anchor portion 542 has a circumference of at least 180 degrees, to ensure that the anchor portion can securely clamp onto the barrel.

Anchor portion 542 connects to alignment guide housing 522 via two arms members 514. Arm members 514 are generally semicircular, but can be any general shape, and have some degree of flexibility to allow gap 532 in anchor portion 542 to expand as need for various barrel obstructions. The number, size, and location of arm members 514 can vary depending on the profile of the firearm barrel on which adapter 500 is intended to be mounted. As depicted, arms 514 travel along the lateral sides of barrel 502 to avoid AK-style iron sight 504, which extends both above and below barrel 502.

Alignment guide housing 522 includes internal threaded surface 526 adapted to threadedly engage threads 528 on muzzle device 523. As depicted best in FIG. 17, muzzle device 523 includes alignment guide 534 with a tapered inner surface for receiving muzzle end 512 of barrel 502. As muzzle device 523 is threaded into alignment guide housing 522, which has been previously secured along the longitudinal axis of barrel 502 via anchor 542, muzzle device 523 translates linearly in a proximal direction (towards the handle of the firearm) causing muzzle end 512 to contact alignment guide 534. The tapered slope of alignment guide 534 forces adapter 500 and muzzle device 523 to axially align with barrel 502.

Alignment guide 534 also creates a seal with muzzle 512. In an embodiment, alignment guide 534 may include a compressible material thereon to further enhance the seal between the alignment guide 534 and muzzle 512. Ultimately, the seal prevents the hot gasses leaving the barrel bore from traveling back towards the firearm operator and forces all of the gasses into muzzle device 523.

As depicted, muzzle device 523 is integrated with alignment guide 534, however, it is considered that muzzle device 523 may be a separate part configured to mount to a muzzle device mount secured to the distal end of alignment guide 534, similar to mount 106 in FIG. 1.

Adapter 500 may also use a fitment insert (not shown) similar to the fitment insert 415 to achieve the same desired effects.

Referring now to FIGS. 19-24, an embodiment of the adapter, generally denoted by reference numeral 600, includes a generally C-shaped anchor 640 adapted to clamp down on at least half of the circumference of barrel 602. Barrel 602 is a common SKS barrel profile, but adapter 600 can be used with any barrel type. Anchor 640 is particularly useful for an SKS barrel 602 because it includes barrel obstructions on the underside of barrel 602. C-shaped anchor 640 has the necessary shape to clamp onto barrel 602 while avoiding these obstructions and still creating an axial alignment between anchor 640 and barrel 602.

As depicted, adapter 600 includes an anchor 640 that is independent from alignment guide 612 and arm members 608. Interior surfaces 620 of anchor 640 are curved to mate with the curved outer surface of barrel 602 and an embodiment also include cutout 613 across the top of interior surface 620 to allow for clearance over irregular upper barrel profiles, like in the case of the square upper profile on the revolver in FIGS. 8-10. Anchor 640 is compressively secured to barrel 602, using for example, upper lever structures 622, 624, which alter the distance between the two halves of C-shaped anchor via pivot pin 646 and fasteners 636. It is consider, however, that anchor 640 may be secured to barrel 602 using any fastening techniques know to a person of ordinary skill in the art.

Outer housing 642 includes a pair of arm members 608 extending from alignment housing guide 610. Arm members 608 create upper and lower cavities intended to accept barrel obstructions. Outer housing 642 reaches around and past the barrel obstructions and receives anchor 640 when slid onto barrel 602. The proximal end of outer housing 618/arm members 608 include inwardly projecting protrusions 618 adapted to engage receipts 628 on the proximal ends of anchor 640 as best depicted in FIG. 22. Protrusions 618 and receipts 628 may have any size and shape so long as protrusions 618 can be received by receipts 628. This interaction helps to align the proximal end of outer housing 642. The distal end of outer housing 642 axially aligns with barrel 602 via the alignment guide 612, which attaches to outer housing 640 at alignment guide housing 610.

Alignment guide 612 includes a central bore and tapered inner surfaces 632 to funnel muzzle end 606 into axial alignment with alignment guide 612. As depicted in FIGS. 20, 23, and 24, alignment guide 612 is in mechanical communication with spring 617, which is in mechanical communication with end cap 616. End cap 616 is secured to alignment guide housing 610, while spring 617 is free to impart a linear force on alignment guide 612 in an axial direction. The spring-based alignment guide improves upon the alignment and sealing ability between the alignment guide and the muzzle.

In an embodiment, alignment guide 612 may include a compressible material thereon to further enhance the seal between the alignment guide 612 and muzzle 632. Ultimately, the seal prevents the hot gasses leaving the barrel bore from traveling back towards the firearm operator and forces all of the gasses into the muzzle device.

End cap 616 further includes a central bore for passage of the projectile and preferably includes threads (not shown) on which a muzzle device may be mounted. Alternatively, the muzzle device may be directly integrated with end cap 616 or any other part of outer housing 608. In addition, a muzzle device may be mounted to end cap 616 according to any methods know to a person of ordinary skill in the art.

Referring now to FIG. 25, an embodiment of the firearm adapter includes housing 704 having an inwardly extending protrusion 719 adapted to engage anchor 742. The depicted embodiment is similar to embodiment 100 in that anchor 742 includes a slot 734 to allow anchor 742 to pass around iron sights 714 and provide inner surface 720 with an adjustable inner diameter. Fasteners 716 similarly pass through fasteners apertures 728 to engage a threaded aperture aligned with fastener apertures 728. Fasteners 716 use the threaded connection to reduce or increase the diameter of inner surface 720 based on the diameter of barrel 702. It is contemplated that any number and any type of fastener known to a person of ordinary skill in the art may be employed to reduce the inner diameter of anchor 742 and secure said anchor to barrel 702. Preferably, the fasteners only engage the anchor to avoid permanently damaging the barrel of the firearm.

Figures 25A, 25B, 25C, 25D:
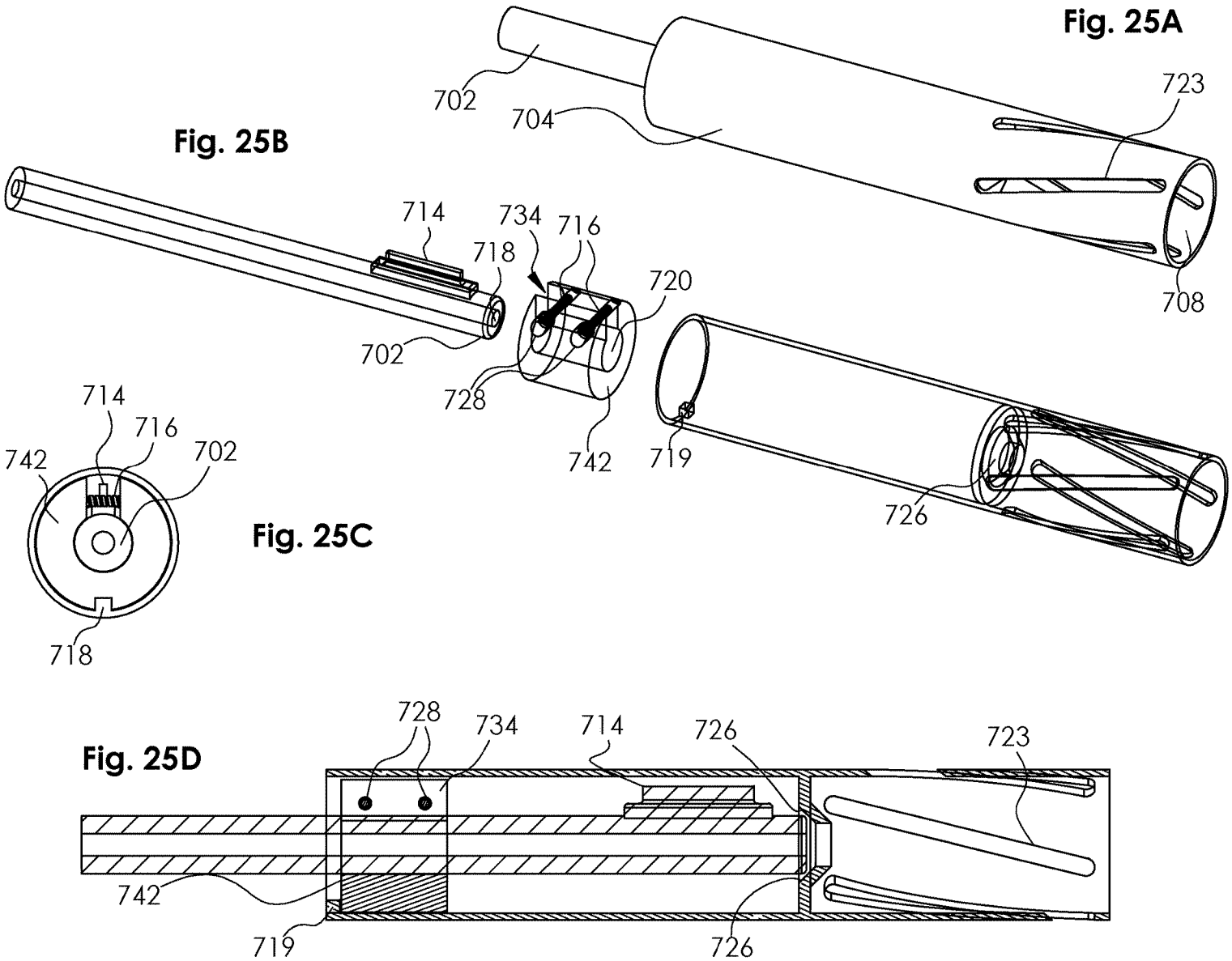
FIG. 25A is a perspective view of an embodiment of the present invention secured to a firearm barrel.
FIG. 25B is a disassembled view of an embodiment of the present invention highlighting the internal mechanisms of the adapter.
FIG. 25C is a cross-sectional view of an embodiment of the present invention.
FIG. 25D is an assembled sectional view of an embodiment of the present invention.

Protrusion 719 is sized and shaped to pass through slot 734. Once protrusion 719 is proximally located with respect to the proximal end of anchor 742, housing 704 is rotated to move protrusion 719 out of alignment with slot 734 as shown in FIG. 25C. As a result, housing 742 is incapable of translating distally with respect to anchor 742 as depicted in FIG. 25D. While only one protrusion is depicted, an embodiment may include any number of protrusions, so long as the anchor includes the necessary channels through which the protrusions can pass when the housing ensleeves the anchor.

As depicted in FIG. 25D, the inner radius of outer housing 104 is greater than the outer radius of firearm barrel 702 plus the height of iron sights 714. Moreover, the length of outer housing 704 is at least as long as the distance from a smooth section of barrel 702, that is proximally located with respect to the obstruction, to the muzzle end. Essentially, housing 704 reaches around and behind obstruction 714 to engage anchor 742. It should be noted that while the exemplary figures depict a barrel obstruction in the form of iron sights 714, the present invention is designed to account for any type of obstruction. The adapter, however, can also be used on barrels without obstructions.

The depicted embodiment of the adapter in FIG. 25 includes a non-suppressor type muzzle device 723 integrated into housing 704 and alignment guide 726 residing within the combination of housing 704 and muzzle device 723. In an embodiment, muzzle housing 723 can be removably attachable to housing 704. Moreover, alignment guide 726 may reside, permanently or temporarily, within housing 704 or muzzle device 723.

As is similar with the previous alignment guides, alignment guide 726 funnels barrel 702 into axial alignment with muzzle device 723 and its projectile aperture 708. Alignment guide 726 has a tapered inner surface for receiving the muzzle end of barrel 702. As housing 704 and in turn alignment guide 726 moves proximally (towards the handle of the firearm) the muzzle end of barrel 702 comes into contact with alignment guide 726 and the tapered slope forces housing 704 to axially align with barrel 702. Alignment guide 726 also creates a seal with the muzzle. In an embodiment, the alignment guide may include a compressible material thereon to further enhance the seal between the alignment guide and the muzzle. Ultimately, the seal prevents the hot gasses leaving the barrel bore from traveling back towards the firearm operator and forces all of the gasses into the suppressor or muzzle device.

FIG. 26 depict a variation of the embodiment depicted in FIG. 25. As depicted in FIG. 26, anchor 742 includes the same components as those found in FIG. 25 (a slot for barrel obstructions, fastener apertures 728, and fasteners 716), with a few additional features. One such features is the inclusion of several adaptability slots 762, which create a discontinuous inner circumference. The adaptability slots further the ability of anchor 742 to adjust in diameter.

Another additional feature is the plurality of protrusion channels 768 disposed in the outer surface of anchor 742. Protrusion channels 768 are sized and shaped to receive a protrusion 719. In addition, protrusion slots 768 are circumferentially spaced about anchor 742 to mirror the circumferential spacing of protrusions 719 about housing 704.

The last depicted additional feature is the plurality of protrusion receipts 770 disposed on the proximal end of anchor 742. Each receipt 770 is circumferentially spaced about anchor 742 to mirror the circumferential spacing of protrusions 719 about housing 704. In the depicted embodiment, receipts 770 and protrusions 719 are angled in a similar fashion to the barrel alignment guide 726. As long as the angled protrusions 770 are smaller than the outer diameter of anchor 742, housing 704 will achieve concentric alignment with respect to anchor 742.

Figures 26A, 26B, 26C, 26D:
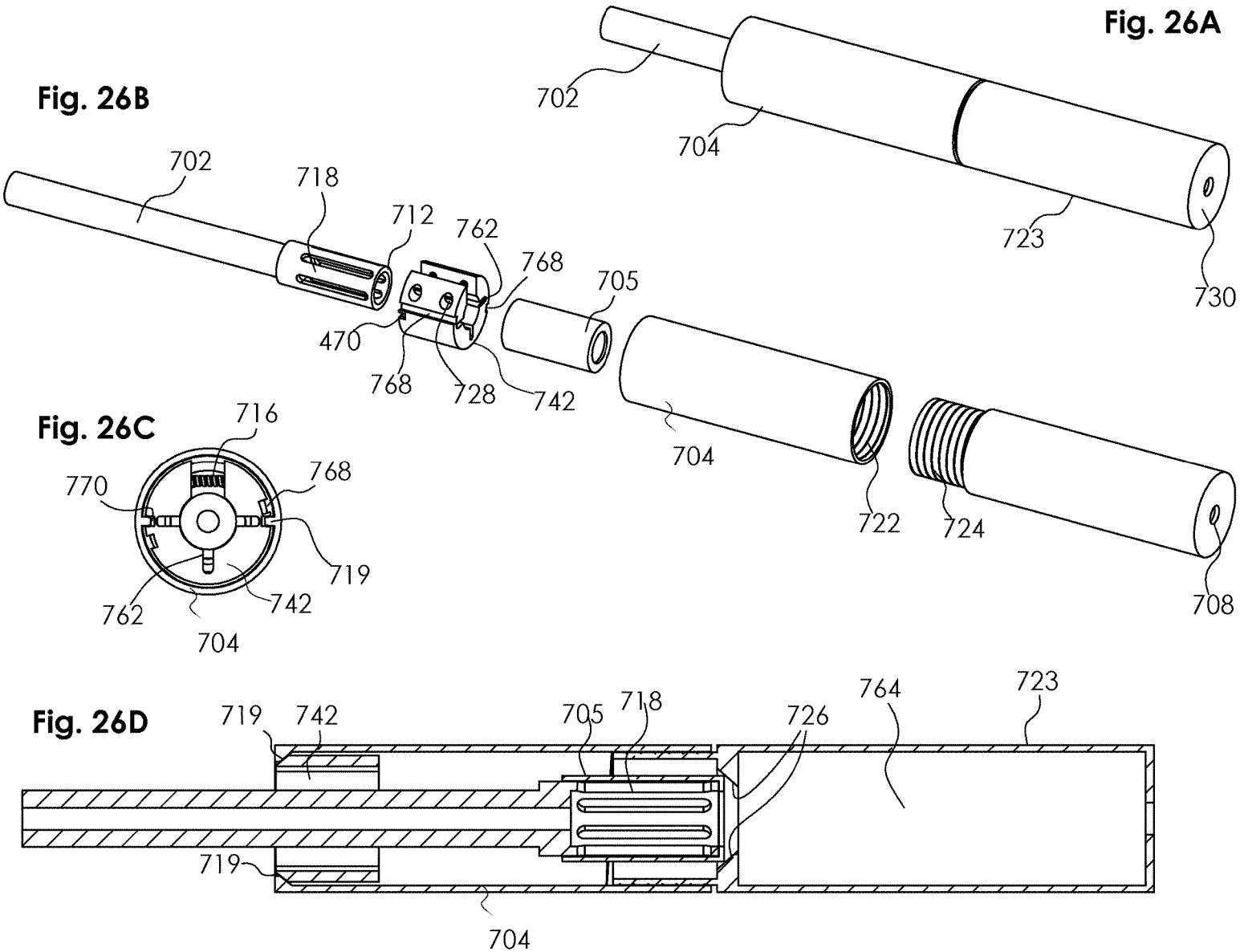
FIG. 26A is a perspective view of an embodiment of the present invention secured to a firearm barrel.
FIG. 26B is a disassembled view of an embodiment of the present invention highlighting the internal mechanisms of the adapter.
FIG. 26C is a cross-sectional view of an embodiment of the present invention.
FIG. 26D is an assembled sectional view of an embodiment of the present invention.
Figures 27A, 27B, 27C, 27D:
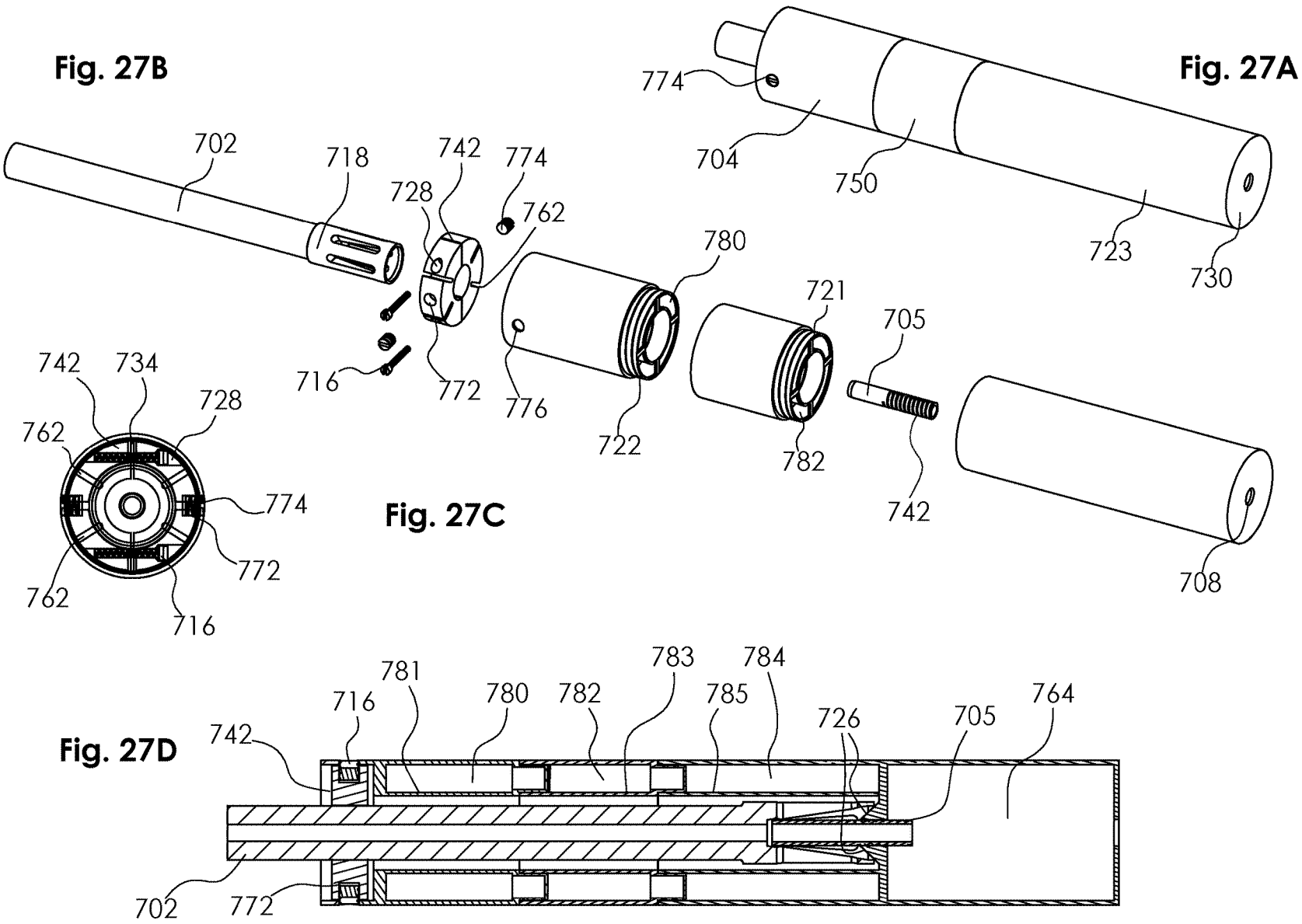
FIG. 27A is a perspective view of an embodiment of the present invention secured to a firearm barrel.
FIG. 27B is a disassembled view of an embodiment of the present invention highlighting the internal mechanisms of the adapter.
FIG. 27C is a cross-sectional view of an embodiment of the present invention.
FIG. 27D is an assembled sectional view of an embodiment of the present invention.

The depicted embodiment of the firearm adapter also includes gas containment sleeve 705, which is designed to prevent expelled gases from exiting the slots in flash hider 718. Gas containment sleeve 705 has an inner diameter greater than the outer diameter of flash hider 718 to ensleeve flash hider 718 as depicted in FIG. 26D. In an embodiment, as shown in FIG. 27D, gas containment sleeve 705 may have an outer diameter sized to reside within flash hider 718 to ensure that all of the expelled gases are redirected out of the gas containment sleeve and into the receiving space 764 of attached muzzled device 723. An embodiment of gas containment sleeve 705 may include threads for threadedly engaging an annular extending support structure (see FIG. 27D) or may include a spring for forcing gas containment sleeve 705 towards the proximal end of the firearm (see FIGS. 28E and 32D).

Referring back to FIG. 26, the depicted embodiment includes threads 722 disposed proximate the distal end of housing 704. Threads 722 are designed to threadedly engage threads 724 disposed on a proximal end of muzzle device 723. In the depicted embodiment, muzzle device 723 includes barrel alignment guide 726 disposed therein. As previously explained, a barrel alignment guide is shaped and sized to funnel the muzzle end of the firearm into axial alignment with housing 704 and muzzled device 723. Barrel alignment guide 726 is disposed within muzzle device 723, such that the threaded connection between housing 704 and muzzled device 723 produces the linear force that brings the firearm muzzle into funneling contact with barrel alignment guide 726. An embodiment, however, may include the barrel alignment guide in mechanical communication with the housing or an extension rather than the muzzle device.

Referring now to FIG. 27, anchor 742 is comprised of two split halves rather than a single body with a slot creating a discontinuous circumference. In other words, the two halves create a slot 734 extending all the way through anchor 742. The two halves are secured to each other through fasteners 716 extending through fastener openings 728. Similar to the embodiment shown in FIGS. 25-26, anchor 742 in FIG. 27 has an adjustable inner diameter by modifying the degree to which fasteners 716 are tightened, which in turn reduces the width of slot 734.

The embodiment of anchor 742 depicted in FIG. 27 also includes a different means for preventing distal, translational movement of housing 704 with respect to anchor 742. As shown best in FIGS. 27C-27D, fasteners 774 pass through their respective apertures 776 and engage threaded receipts 772 in anchor 742. Fasteners 774 are depicted as set screws, but it is considered that other objects can be inserted through passages 776 and receipts 772 to keep housing 704 from translating with respect to anchor 742. For example, an embodiment may include detents on anchor 742 at the location of receipts 772, which can depress into receipts 772 and are spring loaded to extend out of apertures 776 when properly aligned with apertures 776.

FIG. 27 also depict a variation of the housing-to-muzzle device connection, however, any of the other variations of the housing and muzzle device may be used with the depicted anchor. As best depicted in FIGS. 27B and 27D, housing 704 includes threads 722 disposed proximate its distal end and a plurality of gas channels 780. Housing extension 750 includes a proximally located set of threads adapted to engage threads 722 and a plurality of gas channels 782 configured to longitudinally align with gas channels 780. Extension 750 also includes distally located threads 721 adapted to engage a proximal set of threads on muzzle device 723. Muzzle device 723 also includes gas channels 784 configured to longitudinally align with gas channels 782. As shown in FIG. 27D, each of housing 704, extension 750, and muzzle device 723 include inner walls 781, 783, and 785, respectively, to contain discharged gases within gas channels 780, 782, and 784, respectively. Gas channel 784 is fluidically open to receiving space 764, such that the discharged gases can be redirected into the gas channels, which ultimately, reduces the volume of noise when the firearm is discharged.

As depicted in FIG. 27D, an embodiment of gas containment sleeve 750 is designed to threadedly engage an annular extending support section of the housing, extension, or muzzle device. In the depicted embodiment, said support section is also barrel alignment guide 726 having an outer surface tapered in a proximal direction. The inner bore of barrel alignment guide 726 includes threads to engage threads 709 on gas containment sleeve 750. In an embodiment, the distal end of gas containment sleeve 750 includes a tool notch adapted to receive a flat head screwdriver or similar tool to adjust the threaded engagement. The threads allow the depth of gas containment sleeve to be adjusted for different flash hiders. To engage the slot the tool is either inserted through projectile aperture 708 or muzzle device 723 includes a detachable end cap. The end cap is attachable to the muzzle device via threads or any other fastening device known to a person of ordinary skill in the art.

While barrel alignment guide 726 is shown as having a tapered outer surface sized to be received by the distal end of either barrel 704 or flash hider 718, other embodiments of barrel alignment guide 726 have a tapered inner surface where the taper is directed in the opposite direction of that shown in FIG. 27D. Moreover, barrel alignment guide 726 may be spring loaded as depicted in FIGS. 28 and 30, which is discussed in greater detail below.

Figures 28A, 28B, 28C, 28D, 28E:
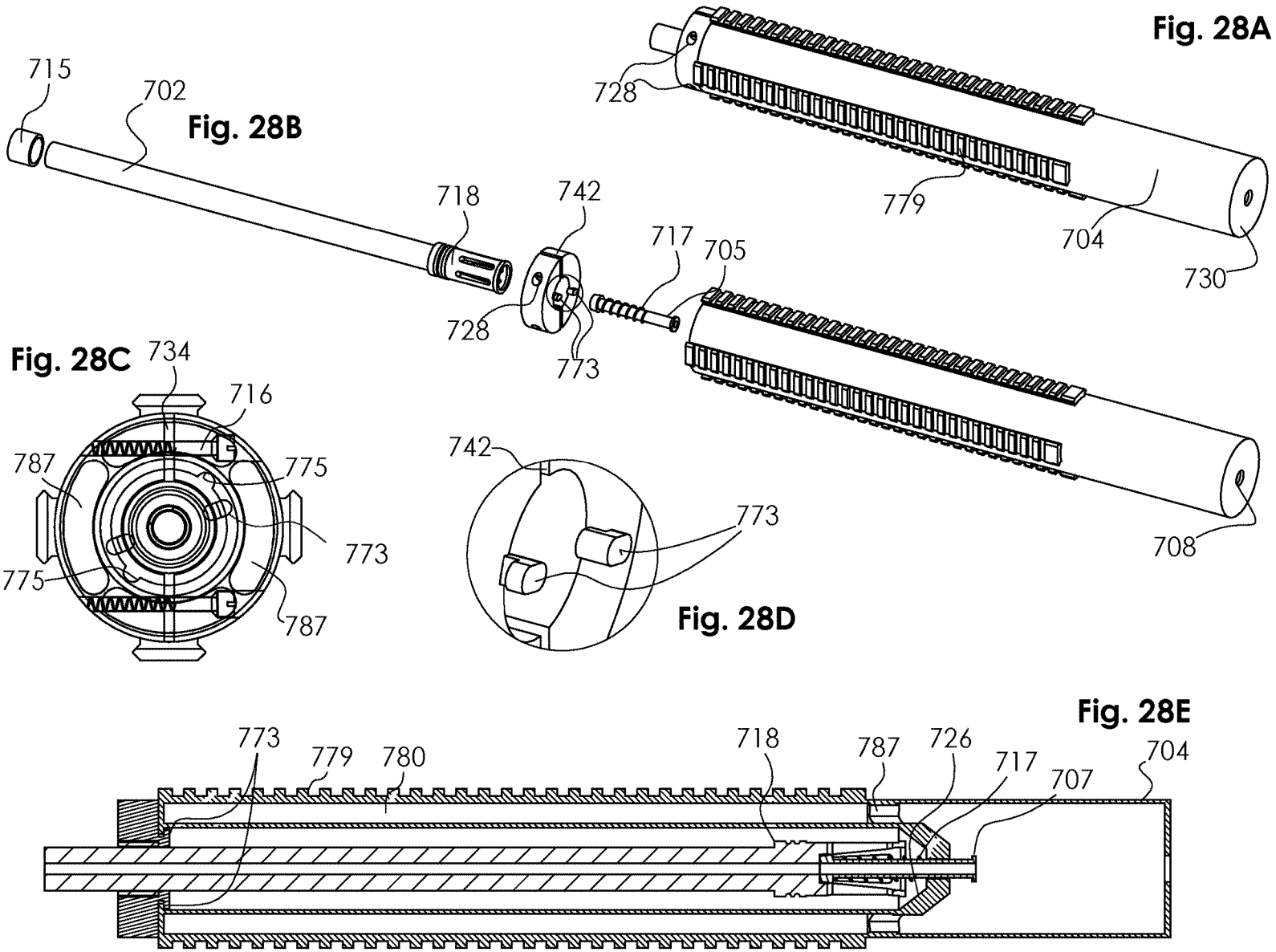
FIG. 28A is a perspective view of an embodiment of the present invention secured to a firearm barrel.
FIG. 28B is a disassembled view of an embodiment of the present invention highlighting the internal mechanisms of the adapter.
FIG. 28C is a cross-sectional view of an embodiment of the present invention.
FIG. 28D is a close-up view of the internal components of the anchor.
FIG. 28E is an assembled sectional view of an embodiment of the present invention.
Figure 29A:
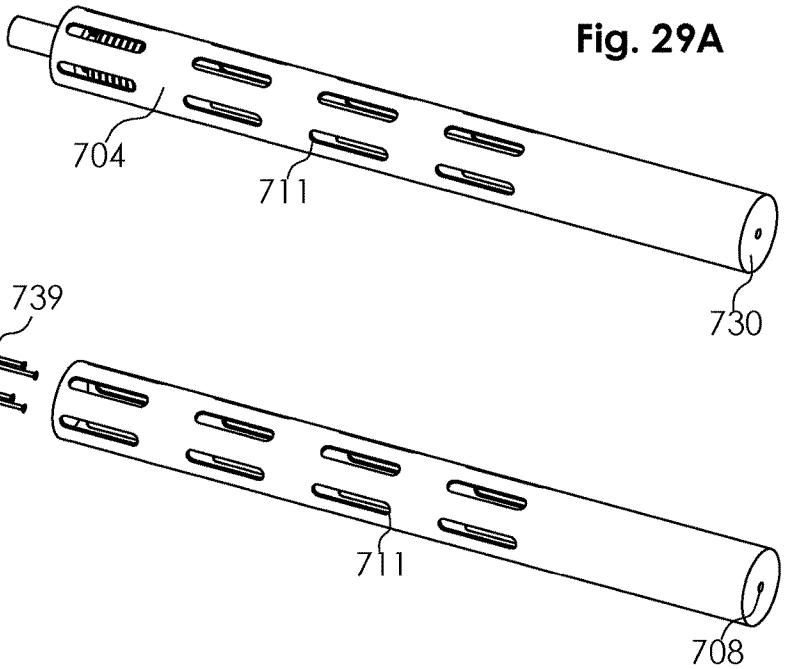
FIG. 29A is a perspective view of an embodiment of the present invention secured to a firearm barrel.
Figure 29B:
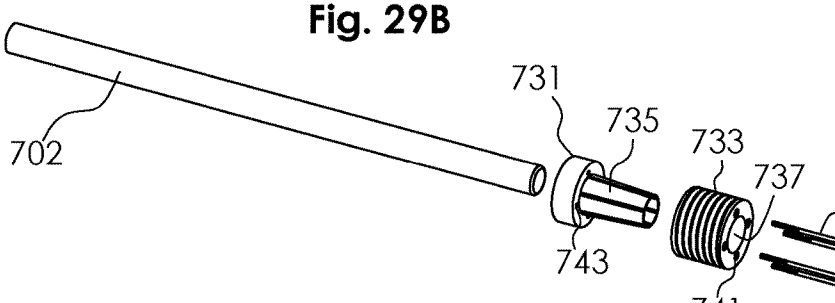
FIG. 29B is a disassembled view of an embodiment of the present invention highlighting the internal mechanisms of the adapter.
Figure 29C:
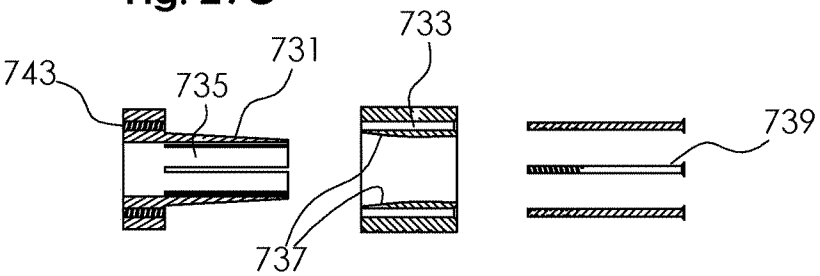
FIG. 29C is a disassembled view of an embodiment of the anchor.
Figure 29D:
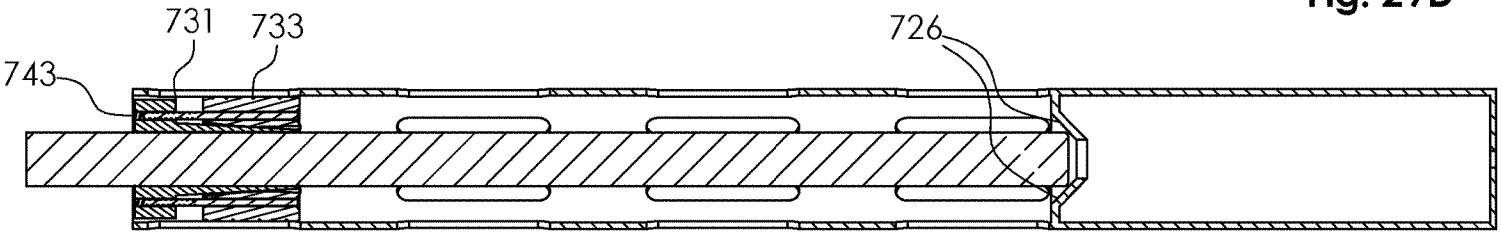
FIG. 29D is an assembled sectional view of an embodiment of the present invention.
Figure 30A:
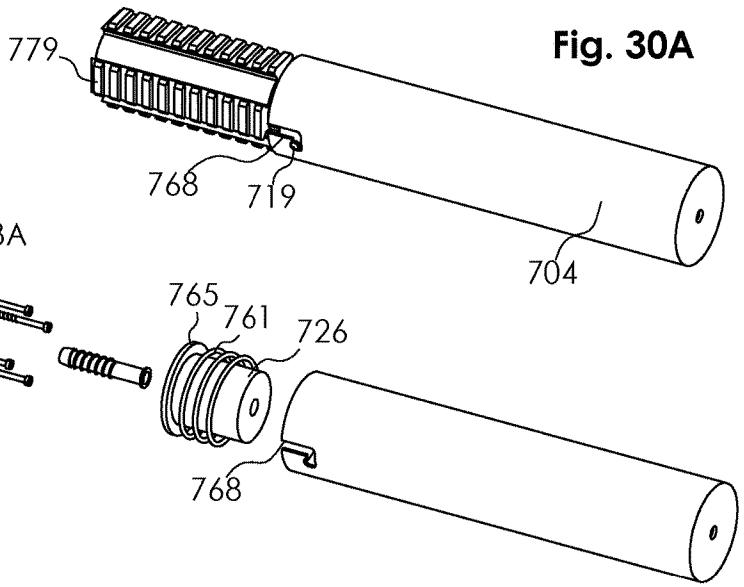
FIG. 30A is a perspective view of an embodiment of the present invention secured to a firearm barrel.
Figure 30B:
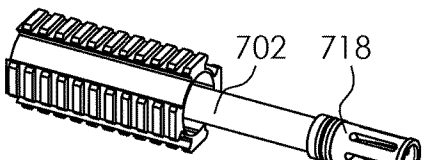
FIG. 30B is a disassembled view of an embodiment of the present invention highlighting the internal mechanisms of the adapter.
Figure 30C:
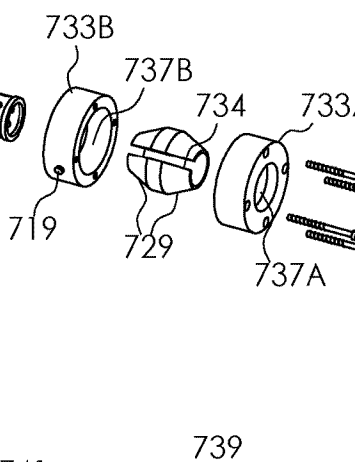
FIG. 30C is a disassembled view of an embodiment of the anchor, gas containment sleeve and alignment guide.
Figure 30C:
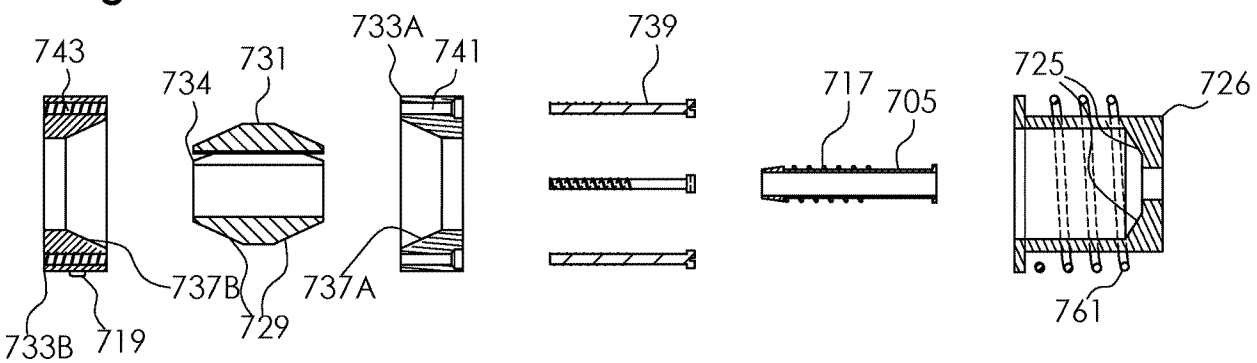
Figure 30D:
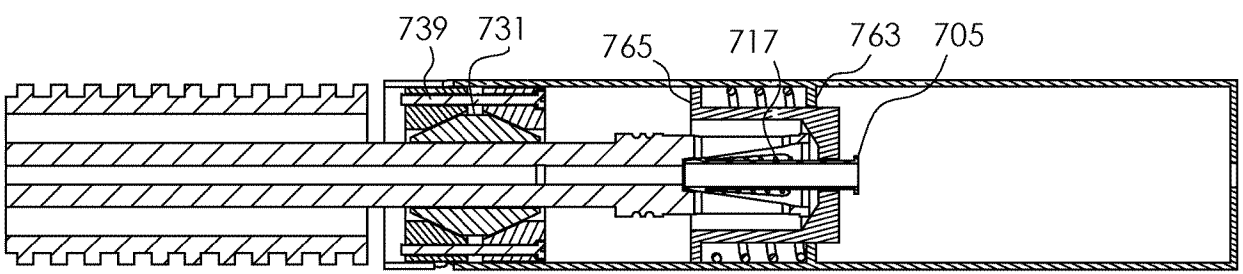
FIG. 30D is an assembled sectional view of an embodiment of the present invention.

Referring now to FIG. 28, an embodiment of anchor 742 includes generally the same design as shown in FIG. 27, but also includes tabs 773 designed to extend distally from anchor 742 and engage housing 704. The depicted embodiment of tabs 773 are generally L-shaped and sized to pass through slots 775 disposed on a proximal face of housing 704. Once tabs 773 have passed through slots 775 and are distally located with respect to the proximal face of housing 704, housing 704 can be rotated with respect to anchor 742 to bring tabs 773 out of alignment with slots 775 as depicted in FIG. 28C. In this orientation, the L-shape of tabs 773 prevent housing 704 from translating in a distal direction with respect to anchor 742.

FIG. 28 also depict the additional fitment sleeve 715 adapted to reside between anchor 742 and barrel 702. The depicted embodiment further includes a variation of housing 704 having an integrated muzzle device, rails 779, gas channels 780, and integrated alignment guide 726. The muzzle device and rails 779 may be any muzzle device and rail design known to a person of ordinary skill in the art. Gas channel 780 extends preferably the length of housing 704 and includes apertures 787 to permit passage of gases between the muzzle device end and the proximal end of housing 704.

As best depicted in FIG. 28E, alignment guide 726 has an inner surface tapered in a distal direction with a section acting as a spring stop for spring 717. Spring 717 resides between a proximal annular flange on gas containment sleeve 705 and alignment guide 726. Spring 726 forces gas containment sleeve 705 in a proximal direction into flash hider 718 to help secure gas containment sleeve in its desired location. Gas containment sleeve 705 also includes annular stop 707 at its distal end to prevent gas containment sleeve 705 from falling out of housing 704 when barrel 702 is removed.

FIG. 29 depict another alternative embodiment of anchor 742 and housing 704. Anchor 742 may be comprised of constricting body 731 and compression ring 733. Constricting body 731 has a discontinuous distal end established by a plurality of distally extending arm members 735 and a tapered outer surface to allow the inner diameter to adjust as arm members 735 are compressed. Compression ring 733 has a consistent inner diameter or an internal surface 737 inversely tapered with respect to constricting body 731. Compression ring 733, when forced onto arm members 735 of constricting body 731 and towards the proximal end of constricting body 731, comes into contact with the tapered outer surface of arm members 735 causing them to constrict in diameter and constricting body 731 becomes fixedly secured to firearm barrel 702. Fasteners 739 pass through apertures 741 in compression ring 733 and engage threaded apertures 743 in constricting body 731. When tightened, fasteners 739 force compression ring 733 towards the proximal end of constricting sleeve 731 to further reduce the internal diameter of constricting body 731 and fixedly secure the anchor to firearm barrel 702. In an embodiment, the fasteners pass through apertures in the constricting body and engage threaded apertures in the compression ring.

FIG. 29 also depict a variation of housing 704 having a muzzle device integrated therewith and rail slots 711. In this embodiment, compression ring 733 includes external threads adapted to engage threads on the internal surface of housing 704. However, the interconnection of housing 704 and compression ring 733 may be achieved by any means described herein.

FIG. 30 depict a variation of anchor 742, housing 704 and alignment guide 726. Anchor 742 is comprised of constricting body 731 and compression ring 733A, 733B. Constricting body 731 has an ovoid shape with tapered outer surfaces 729 and adjustment slot 734. The compression ring is separated into two halves 733A and 733B. Each half has a tapered inner surface 737A, 737B, such that enclosing constricting body 731 within the two halves of compression ring 733A, 733B cause constricting body 731 to constrict inwardly in a radial direction and tighten around barrel 702. Fasteners 739 pass through apertures 741 in compression ring 733A and engage threaded apertures 743 in compression ring 733B. When tightened, fasteners 739 force compression rings 733A, 733B towards each other to further reduce the internal diameter of constricting body 731 and fixedly secure the anchor to firearm barrel 702.

At least one of the two halves of compression ring 733A, 733B further includes projection 719 extending radially from its outer surface. Housing 704 include a projection passage 768 which is generally L-shaped. Working in conjunction, housing 704 ensleeves the anchor such that projection 719 passes through projection passage 768 and then housing 704 is rotated to bring projection 719 around the corner of the L-shaped projection passage 768. In this orientation, housing 704 is incapable of translating in a distal direction with respect to the anchor. It is contemplated that the projection can extend from the housing and the passage can be disposed in the anchor to achieve the same result.

The embodiment of gas containment sleeve 705 is generally the same between FIGS. 28 and 30, but barrel alignment guide 726 in FIG. 30 is spring load. Alignment guide 726 includes spring stop 765 at its proximal end and spring 761 disposed between spring stop 765 and annular projection 763 extending inwardly from housing 704. Alignment guide 726 is adapted to slidably translate within housing 704 to engage the muzzle end of flash hider 718 or barrel 702. The tapered inner surface 725 of alignment guide 726 brings the muzzle end of flash hider 718 or barrel 702 into axial alignment with housing 704.

Regardless of the embodiment, each of the adapters is configured to automatically align the barrel of a firearm with a muzzle device. Furthermore, the anchoring portions of each adapter may be secured to the barrel of a firearm according to any methods known to a person of ordinary skill in the art and preferably remain detachable from said firearm.

As depicted in each exemplary image, the adapters are generally cylindrical in shape, but may have any shape that allows the anchor to be secured to the barrel of a firearm while also axially aligning with the barrel of the firearm.

While the different exemplary images show several distinct anchors, housings, and gas containment sleeves, each adapter may be used with any of the variations of the anchors, housings, and gas containment sleeves through minor adjustments in design. In addition, each adapter may be used with various different barrels, including those with and without barrel obstructions. Moreover, barrel obstructions generally include any features on or near the barrel of a firearm that results in a non-circular cross-section of the barrel.

Each of the embodiments of the adapter may be used with a fitment insert or sleeve. The fitment inserts provide an inexpensive and highly variable means for fitting a single size adapter to most firearms without having to modify the firearm barrel. A tapered fitment sleeve may also be used on tapered barrels to effectively create a non-tapered barrel.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A firearm adapter for securing a muzzle device to a firearm, comprising:

an anchor, the anchor including:

a proximal end and a distal end with a length extending therebetween and a longitudinal axis extending parallel to the length;

an outer surface and an inner surface, at least a section of the inner surface of the anchor having a circular or semi-circular cross-sectional shape, with a radius greater than a radius of a firearm barrel when the anchor is attached to the firearm barrel;

the anchor attachable to the firearm barrel by contracting around a smooth section of the firearm barrel;

a housing, the housing including:

a length extending parallel to a longitudinal axis;

a proximal end of the housing adapted to attach to or engage the anchor to prevent relative axial movement between the anchor and the housing with respect to the longitudinal axis;

a distal end having a projectile aperture axially aligned with the longitudinal axis of the housing; and the housing being integrated with or attachable to a muzzle device.

2. The firearm adapter of claim 1, further including a protrusion proximate a proximal end of the housing, the protrusion extending in a radial direction towards the anchor and adapted to engage the anchor and thereby prevent movement of the housing with respect to the firearm in a longitudinal direction.

3. The firearm adapter of claim 1, further including threads disposed on the anchor and threads disposed on the housing proximate the proximal end of the housing, wherein the threads on the housing are adapted to threadedly engage the threads on the anchor.

4. The firearm adapter of claim 1, further including a gap extending at least partially along the length of the anchor and passing through both the inner and outer surfaces, such that at least a section of the anchor has an adjustable cross-sectional area.

5. The firearm adapter of claim 1, further including a fastener aperture proximate the proximal end of the housing and a fastener receipt disposed in the anchor, such that a fastener can pass through the fastener aperture and engage the fastener receipt to secure the housing to the anchor.

6. The firearm adapter of claim 1, further including an alignment guide residing at least partially within the housing or muzzle device, the alignment guide having a central bore hole sized to permit passage of a projectile, but prevent passage of a firearm muzzle or a pre-existing muzzle device secured to the firearm.

7. The firearm adapter of claim 6, wherein the alignment guide has a frustoconical shape and tapers towards the central longitudinal axis, the frustoconical shape thereby funneling the muzzle or pre-existing muzzle device into axial alignment with the central longitudinal axis.

8. The firearm adapter of claim 1, further including a gas containment sleeve secured to or integrated with the alignment guide, the gas containment sleeve sized to reside within a pre-existing muzzle device or ensleeve the pre-existing muzzle device, the gas containment sleeve being gas impermeable to prevent discharged gasses from laterally escaping through the pre-existing muzzle device.

9. The firearm adapter of claim 1, wherein the muzzle device is a suppressor.

10. The firearm adapter of claim 1, further including a projection extending in a radial direction from the anchor towards the housing and a projection passage disposed on the housing, the projection passage adapted to receive the projection and prevent movement of the housing with respect to the anchor in a longitudinal direction.

11. A firearm adapter for securing a muzzle device to a firearm, comprising:

an anchor, the anchor including:

a proximal end and a distal end with a length extending therebetween and a longitudinal axis extending parallel to the length;

an outer surface and an inner surface, at least a section of the inner surface of the anchor having a circular or semi-circular cross-sectional shape, with a radius greater than a radius of a firearm barrel when the anchor is attached to the firearm barrel;

the anchor attachable to the firearm barrel by contracting around a smooth section of the firearm barrel;

a housing, the housing including:

a length extending parallel to a longitudinal axis;

a proximal end of the housing adapted to attach to or engage the anchor to prevent relative axial movement between the anchor and the housing with respect to the longitudinal axis;

a distal end having a projectile aperture axially aligned with the longitudinal axis of the housing;

the housing being integrated with or attachable to a muzzle device; and an alignment guide residing at least partially within the housing or muzzle device, the alignment guide having a central bore hole sized to permit passage of a projectile, but prevent passage of a firearm muzzle or a pre-existing muzzle device secured to the firearm.

12. The firearm adapter of claim 11, further including a protrusion proximate a proximal end of the housing, the protrusion extending in a radial direction towards the anchor and adapted to engage the anchor and thereby prevent movement of the housing with respect to the firearm in a longitudinal direction.

13. The firearm adapter of claim 11, further including threads disposed on the anchor and threads disposed on the housing proximate the proximal end of the housing, wherein the threads on the housing are adapted to threadedly engage the threads on the anchor.

14. The firearm adapter of claim 11, further including a gap extending at least partially along the length of the anchor and passing through both the inner and outer surfaces, such that at least a section of the anchor has an adjustable cross-sectional area.

15. The firearm adapter of claim 11, further including a fastener aperture proximate the proximal end of the housing and a fastener receipt disposed in the anchor, such that a fastener can pass through the fastener aperture and engage the fastener receipt to secure the housing to the anchor.

16. The firearm adapter of claim 11, wherein the alignment guide has a frustoconical shape and tapers towards the central longitudinal axis, the frustoconical shape thereby funneling the muzzle or pre-existing muzzle device into axial alignment with the central longitudinal axis.

17. The firearm adapter of claim 11, further including a gas containment sleeve secured to or integrated with the alignment guide, the gas containment sleeve sized to reside within a pre-existing muzzle device or ensleeve the pre-existing muzzle device, the gas containment sleeve being gas impermeable to prevent discharged gasses from laterally escaping through the pre-existing muzzle device.

18. The firearm adapter of claim 11, wherein the muzzle device is a suppressor.

19. The firearm adapter of claim 11, further including a projection extending in a radial direction from the anchor towards the housing and a projection passage disposed on the housing, the projection passage adapted to receive the projection and prevent movement of the housing with respect to the anchor in a longitudinal direction.

20. A firearm adapter for securing a muzzle device to a firearm, comprising:

an anchor, the anchor including:

a proximal end and a distal end with a length extending therebetween and a longitudinal axis extending parallel to the length;

an outer surface and an inner surface, at least a section of the inner surface of the anchor having a circular or semi-circular cross-sectional shape, with a radius greater than a radius of a firearm barrel when the anchor is attached to the firearm barrel;

the anchor attachable to the firearm barrel by contracting around a smooth section of the firearm barrel;

a housing, the housing including:

a length extending parallel to a longitudinal axis;

a proximal end of the housing adapted to attach to or engage the anchor to prevent relative axial movement between the anchor and the housing with respect to the longitudinal axis;

a distal end having a projectile aperture axially aligned with the longitudinal axis of the housing;

the housing being integrated with or attachable to a muzzle device;

an alignment guide residing at least partially within the housing or muzzle device, the alignment guide further including:

a central bore hole sized to permit passage of a projectile, but prevent passage of a firearm muzzle or a pre-existing muzzle device secured to the firearm; and a frustoconical shape that tapers towards the central longitudinal axis, the frustoconical shape thereby funneling the muzzle or pre-existing muzzle device into axial alignment with the central longitudinal axis.

* * * * *